United States Patent [19]

Nagai et al.

[11] Patent Number: 4,761,950

[45] Date of Patent: Aug. 9, 1988

[54] DOUBLE AIR-FUEL RATIO SENSOR SYSTEM CARRYING OUT LEARNING CONTROL OPERATION

[75] Inventors: Toshinari Nagai, Susono; Takatoshi Masui; Yasushi Satou, both of Mishima; Toshiyasu Katsuno, Susono, all of Japan

[73] Assignee: Toyota Jidosha Kabushiki Kaisha, Aichi, Japan

[21] Appl. No.: 903,977

[22] Filed: Sep. 4, 1986

[30] Foreign Application Priority Data

Sep. 10, 1985 [JP] Japan ..... 60-198587

[51] Int. Cl.[4] ..... F02D 41/14

[52] U.S. Cl. ..... 60/274; 60/276; 60/285; 123/489

[58] Field of Search ..... 123/440, 489, 589; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,251,989 | 2/1981 | Norimatsu et al. | 60/276 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-152147 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors. A center value of an air-fuel ratio correction amount or an air-fuel ratio feedback control parameter calculated based upon the output of the downstream-side air-fuel ratio sensor is calculated by a learning control, and an air-fuel ratio feedback control is initiated by using the center value when the engine enters into an air-fuel ratio feedback control state.

28 Claims, 35 Drawing Sheets

| Fig. 3 A | Fig. 3 B | Fig. 3 C |
|---|---|---|

LEAN
RICH
A/F1
TDR1
CDLY1

0
t1
t2
t3
t4
t5
t6
t7
t8
TDL1
A/F1'
(F1)

TDR1
(-TDL1)
LEAN
RICH
TDR1

KIR
FAF1
RSL
RSR
KIL

| Fig. 5 A | Fig. 5 B | Fig. 5 C |
|---|---|---|

V
1
0
V1
VR1
RICH
LEAN
TDR1
(-TDL1)
F1
KIR
RSL
FAF1
RSR
KIL
V2
VR2
LEAN
RICH
(-TDL2)
TDR2
F2
KI2
RS2
FAF2
RS2
KI2
RS2

| Fig. 14A | Fig. 14B |
|---|---|
| Fig. 14C | |

V
1
0
V1
VR1

RICH
LEAN

TDR1
(-TDL1)
F1

KIR
RSL
FAF1
RSR
KIL

V
1
0
V2
VR2

LEAN
RICH (-TDL2)
TDR2
F2

MAX
RSR
MIN

MAX
RSL
MIN

| Fig.19A | Fig.19B |
|---|---|
| Fig.19C | |

LEAN
RICH
A/F1

TDL1
CDLY1
0
t1 t2 t3 t4 t5 t6 t7 t8
TDR1

(-TDR1)
LEAN
RICH
TDL1
(-TDR1)
A/F1'
(F1)

KIR
KIL
FAF1
RSL
RSR

DOUBLE AIR-FUEL RATIO SENSOR SYSTEM CARRYING OUT LEARNING CONTROL OPERATION

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons.

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, an air-fuel ratio correction coefficient FAF2 or an air-fuel ratio feedback control parameter such as a skip amount RSR (RSL) controlled by the output of the downstream-side $O_2$ sensor in an air-fuel ratio feedback control state may be greatly deviated from such an air-fuel ratio correction coefficient or an air-fuel ratio feedback control parameter in a non air-fuel ratio feedback control (open control) state. As a result, in this case, when the engine control is changed from an open control state to an air-fuel ratio feedback control state by the upstream-side and downstream-side $O_2$ sensors, since the response speed of an air-fuel ratio feedback control operation by the downstream-side $O_2$ sensor is smaller than that of the upstream-side $O_2$ sensor, it will take a long time for the air-fuel ratio correction coefficient FAF2 or the skip amount RSR (RSL) to reach an optimum level, i.e., it will take a long time for the controlled air-fuel ratio to reach an optimum level, thereby causing an overrich or overlean condition in the controlled air-fuel ratio, and thus deteriorating the fuel consumption, the drivability, and the condition of the exhaust emissions such as HC, CO, and $NO_X$, since the air-fuel ratio correction coefficient FAF2 (=0.1) or the skip amount RSR (RSL) during an open-loop control is, in this case, not an optimum level, which is a problem.

Also, even during an air-fuel ratio feedback control by the downstream-side $O_2$ sensor, when the engine is transferred from one driving region to another driving region, the optimum level of the controlled air-fuel ratio is shifted, thus creating the abovementioned problem.

Note that, when the engine is transferred from an open control state to an air-fuel ratio feedback control state by the downstream-side $O_2$ sensor, the response speed of the air-fuel ratio feedback control could be promoted by the downstream-side $O_2$ sensor for a definite time period after this transition, so that the controlled air-fuel ratio promptly reaches an optimum level. In this case, however, undershoot or overshoot of the controlled air-fuel ratio may occur, since the downstream-side $O_2$ sensor may respond to a rich spike or a lean spike of the air-fuel ratio.

SUMMARY OF THE INVENTION

It is an object of the present invention to provide a double air-fuel ratio sensor system in an internal combustion engine with which the fuel consumption, the drivability, and the exhaust emission characteristics are improved after the engine enters into an air-fuel ratio feedback control by the downstream-side $O_2$ sensor and during an air-fuel ratio feedback control in which the engine is transferred from one driving region to another driving region.

According to the present invention, in a double air-fuel ratio sensor system including two $O_2$ sensors upstream and downstream of a catalyst converter provided in an exhaust passage, an actual air-fuel ratio is adjusted by using the output of the upstream-side $O_2$ sensor and the output of the downstream-side $O_2$ sensor. A center value of the air-fuel ratio correction coefficient FAF2 or the air-fuel ratio feedback control parameter such as the skip amount RSR (RSL) is calculated by a learning control, and an air-fuel ratio feedback control is initiated by using such a center value when the engine enters into an air-fuel ratio feedback control state.

Also, the above-mentioned center value is calculated for each driving region, and an air-fuel ratio feedback control is initiated by using such a center value for the current driving region when the engine is transferred from one driving region to another driving region.

BRIEF DESCRIPTION OF THE DRAWINGS

The present invention will be more clearly understood from the description as set forth below with reference to the accompanying drawings, wherein:

FIGS. 3, 3A–3C, 5, 5A–5C, 6, 7, 8, 11, 11A–11D, 12, 14, 14A–14C, 15, 16, 19, 19A–19C and 20 are flow charts showing the operation of the control circuit of FIG. 2;

DESCRIPTION OF THE PREFERRED EMBODIMENTS

Figure 1:
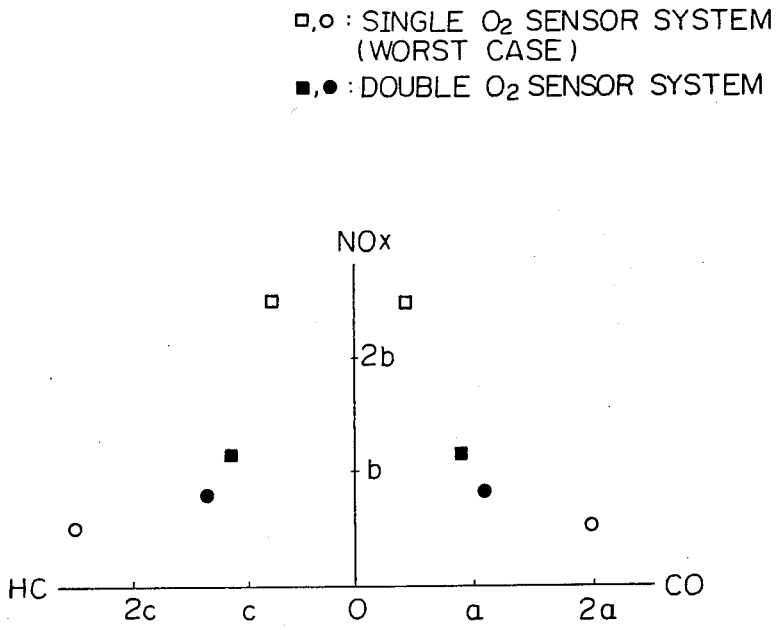
FIG. 1 is a graph showing the emission characteristics of a single $O_2$ sensor system and a double $O_2$ sensor system.
Figure 2:
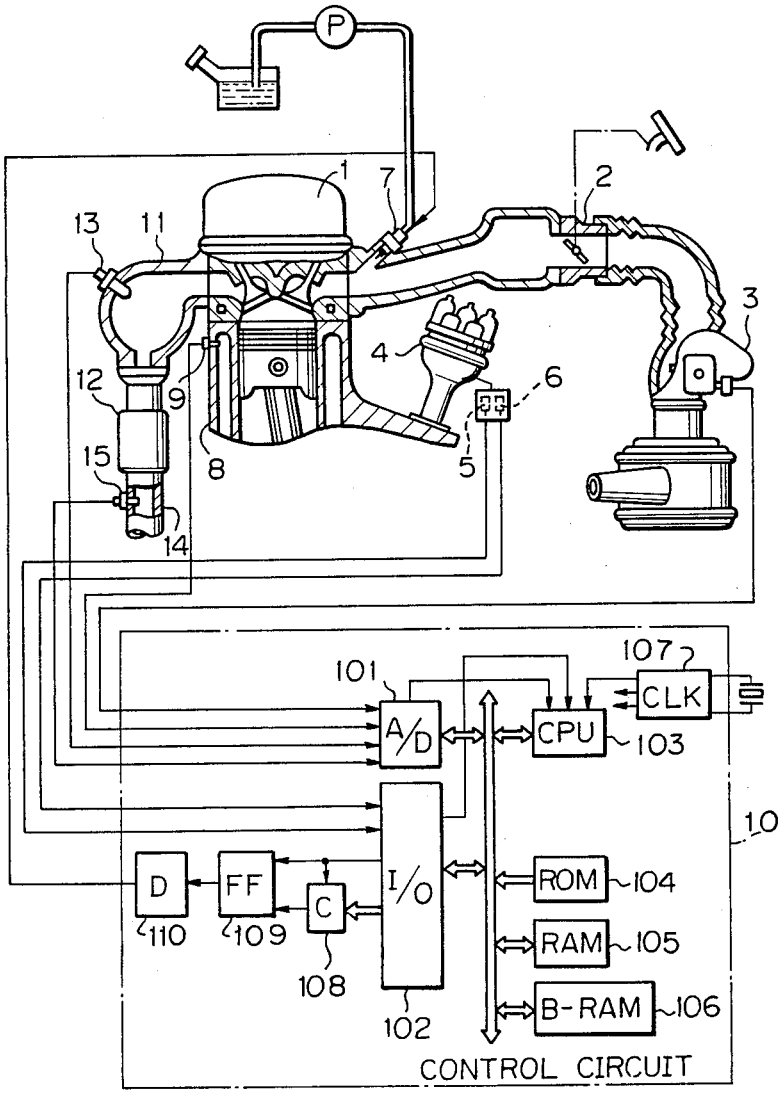
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set.

As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figures 3, 3A:
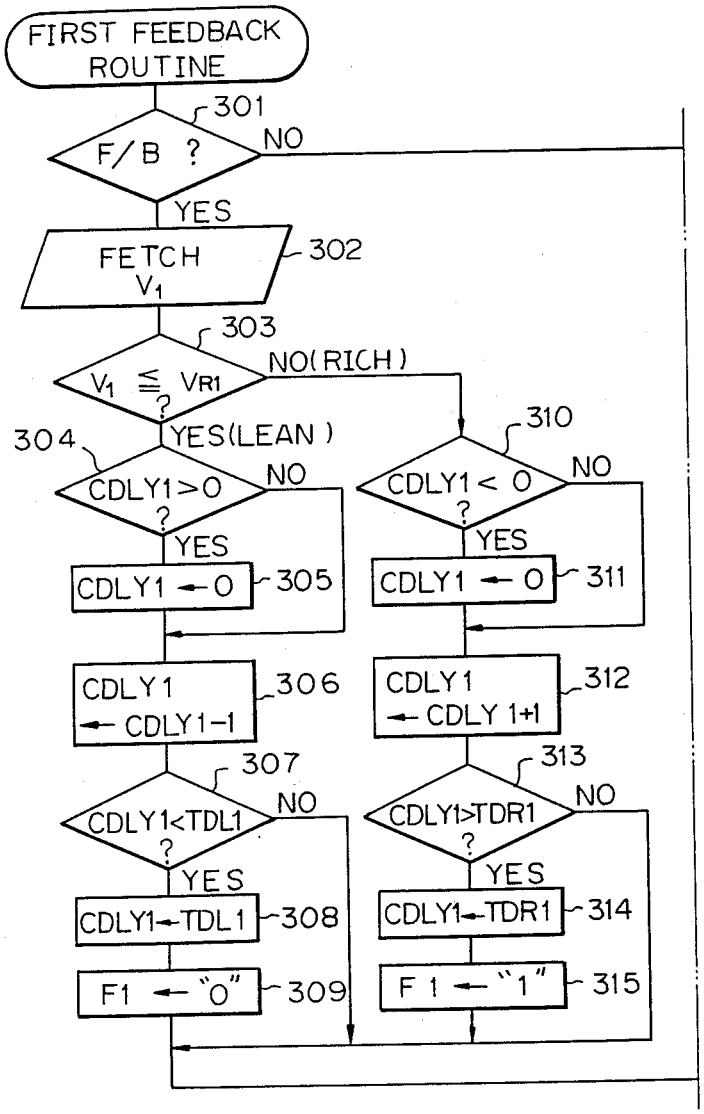
Figure 3B:
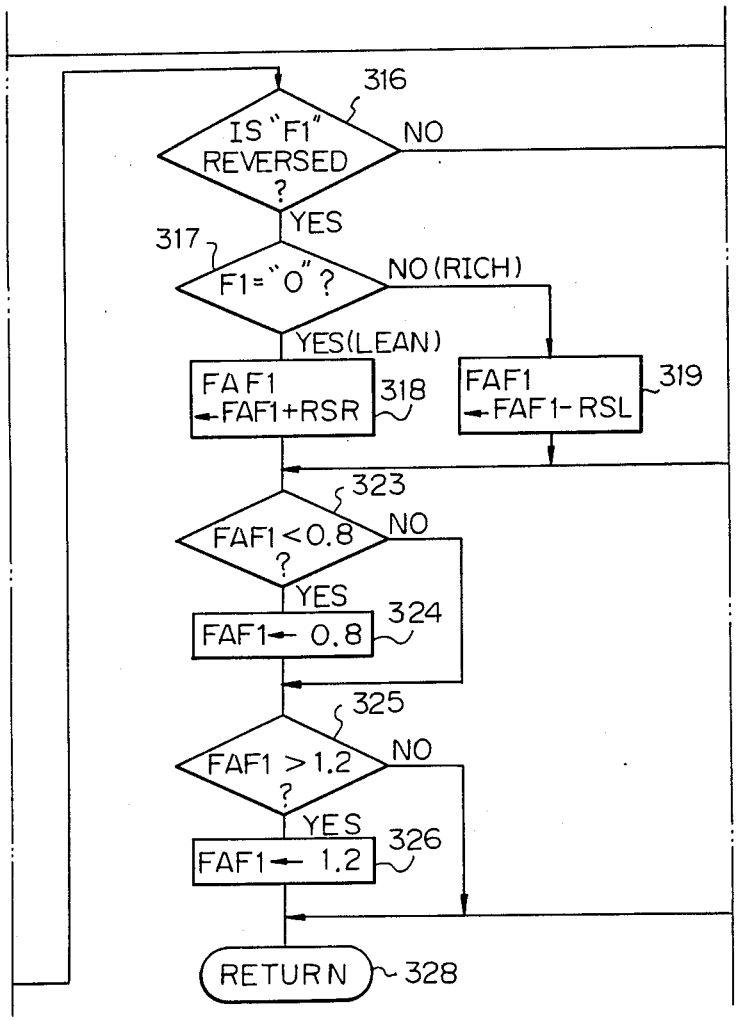
Figure 3C:
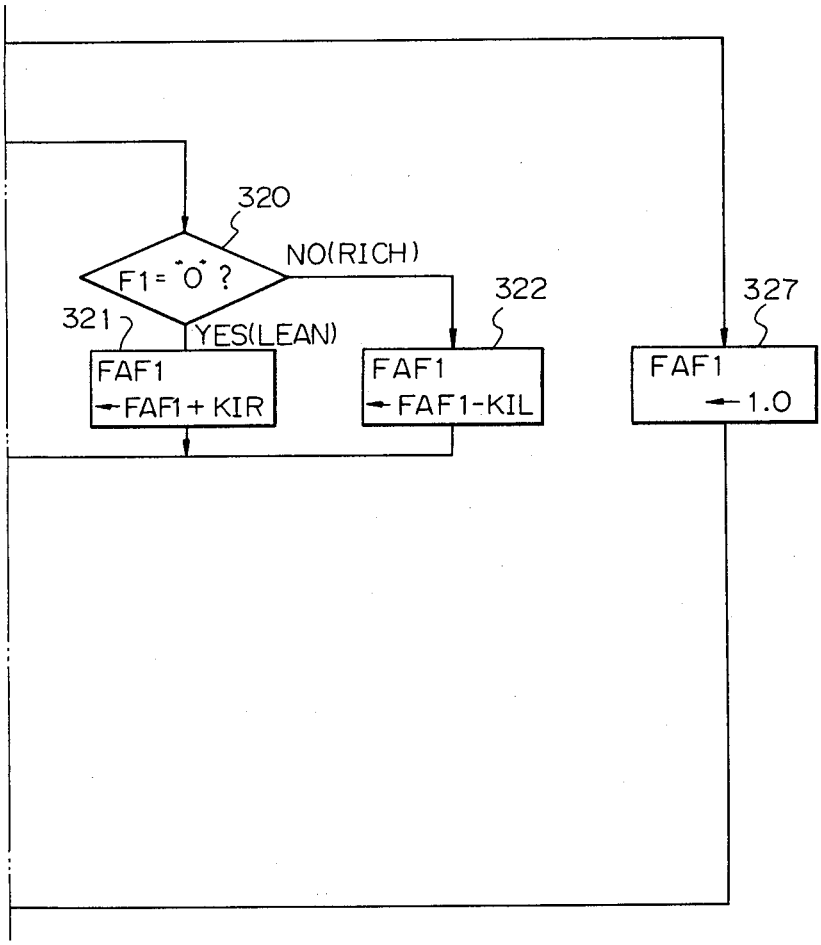

FIG. 3 is a routine for calculating a first air-fuel ratio feedback correction amount FAF1 in accordance with the output of the upstream-side $O_2$ sensor 13 executed at every predetermined time period such as 4 ms.

At step 301, it is determined whether or not all the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) the power fuel incremental amount FPOWER is 0; and (iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether of not the output of the upstream-side $O_2$ sensor 13 is once swung, i.e., one changed from the rich side to the lean side, or vice verse. Of course, other feedback control conditions are introduced as occasion demands. However, an explanation of such other feedback control condition is omitted.

If one or more of the feedback control conditions is not satisfied, the control proceeds to step 327, in which the amount FAF1 is caused to be 1.0 (FAF1=1.0), thereby carrying out an open-loop control operation.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a first delay counter CDLY1 is positive. If CDLY1>0, the control proceeds to step 305, which clears the first delay counter CDLY1, and then proceeds to step 306. If CDLY1≦0, the control proceeds directly to step 306. At step 306, the first delay counter CDLY1 is counted down by 1, and at step 307, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 307, only when CDLY1<TDL1 does the control proceed to step 308, which causes CDLY1 to be TDL1, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the first delay counter CDLY1 is negative. If CDLY1<0, the control proceeds to step 311, which clears the first delay counter CDLY1, and then proceeds to step 312. If CDLY1≧0, the control directly proceeds to 312. At step 312, the first delay counter CDLY1 is counted up by 1, and at step 313, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 313, only when CDLY1>TDR1 does the control proceed to step 314, which causes CDLY1 to be TDR1, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 319, which carry out a skip operation. That is, at step 317, if the flag F1 is "0" (lean) the control proceeds to step 318, which remarkably increases the correction amount FAF by a skip amount RSR. Also, if the flag F1 is "1" (rich) at step 317, the control proceeds to step 319, which remarkably decreases the correction amount FAF by the skip amount RSL.

On the other hand, if the first air-fuel ratio flag F1 is not reversed at step 316, the control proceeds to step 320 to 322, which carry out an integration operation. That is, if the flag F1 is "0" (lean) at step 320, the control proceeds to step 321, which gradually increases the correction amount FAF1 by a rich integration amount KIR. Also, if the flag F1 is "1" (rich) at step 320, the control proceeds to step 322, which gradually decreases the correction amount FAF1 by a lean integration amount KIL.

The correction amount FAF1 is guarded by a minimum value 0.8 at steps 323 and 324, and by a maximum value 1.2 at steps 325 and 326, thereby also preventing the controlled air-fuel ratio from becoming overrich or overlean.

The correction amount FAF1 is then stored in the RAM 105, thus completing this routine of FIG. 3 at step 328.

Figures 4A, 4B, 4C, 4D:
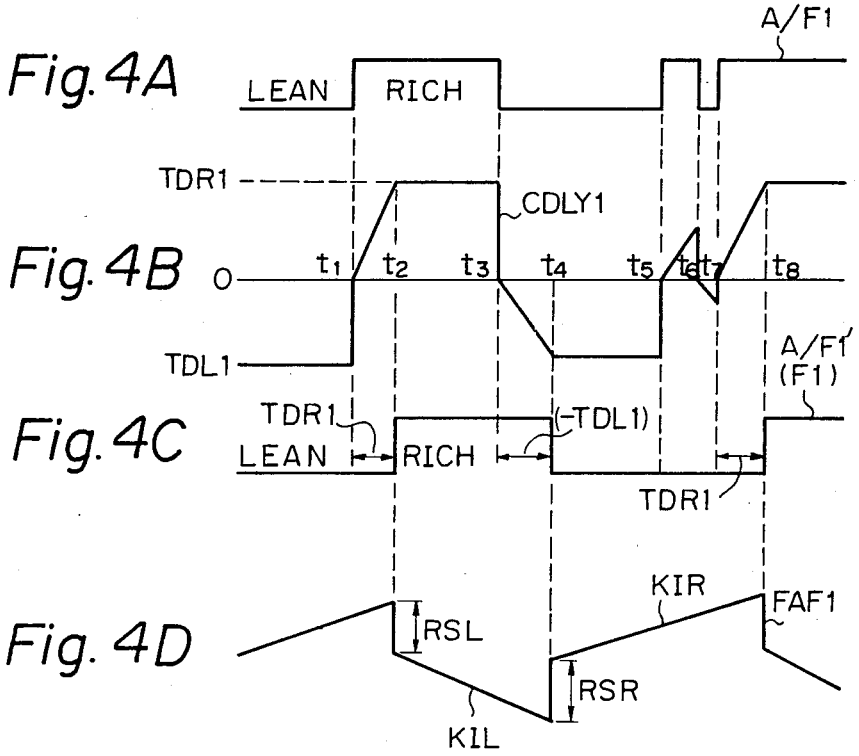
FIGS. 4A through 4D are timing diagrams explaining the flow chart of FIGS. 3, 3A–3C.

The operation by the flow chart of FIG. 3 will be further explained with reference to FIGS. 4A through 4D. As illustrated in FIG. 4A, when the air-fuel ratio A/F1 is obtained by the output of the upstream-side $O_2$ sensor 13, the first delay counter CDLY1 is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_1$, even when the air-fuel ratio A/F is changed from the lean side to the rich side, the delayed air-fuel ratio A/F1' (F1) is changed at time $t_2$ after the rich delay time period TDR1. Similarly, at time $t_3$, even when the air-fuel ratio A/F1 is changed from the rich side to the lean side, the delayed air-fuel ratio F1 is changed at time $t_4$ after the lean delay time period TDL1. However, at time $t_5$, $t_6$, or $t_7$, when the air-fuel ratio A/F1 is reversed within a smaller time period than the rich delay time period TDR1 or the lean delay time period TDL1, the delay air-fuel ratio A/F1' is reversed at time $t_8$. That is, the delayed air-fuel ratio A/F1' is stable when compared with the air-fuel ratio A/F1. Further, as illustrated in FIG. 4D, at every change of the delayed air-fuel ratio A/F1 from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air-fuel ratio feedback control parameter, there are nominated a delay time period TD (in more detail, the rich delay time period TDR1 and the lean delay time period TDL1), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes larger than the lean delay time period (TDR1>(−TDL1)), the controlled air-fuel ratio becomes richer, and if the lean delay time period becomes larger than the rich delay time period ((−TDL1)>TDR1), the controlled air-fuel ratio becomes leaner. Thus, the air-fuel ratio can be controlled by changing the rich delay time period TDR1 and the lean delay time period (−TDL1) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 5, 6, 7, and 8.

Figures 5, 5A:
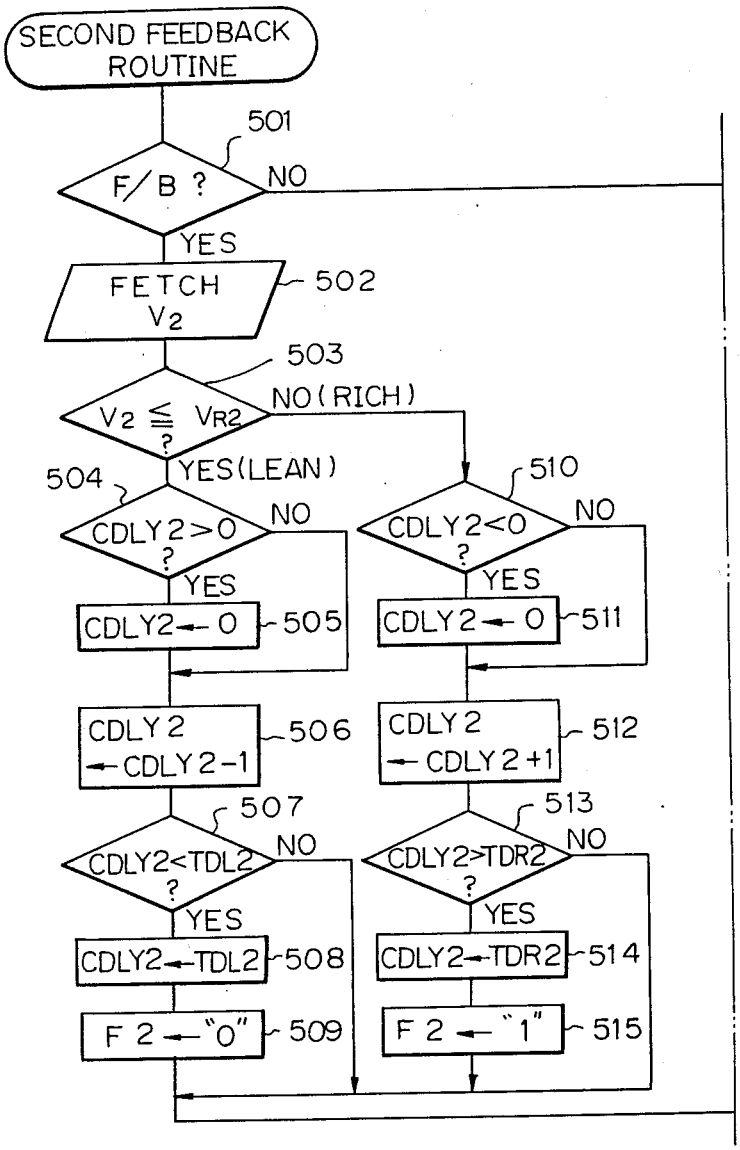
Figure 5B:
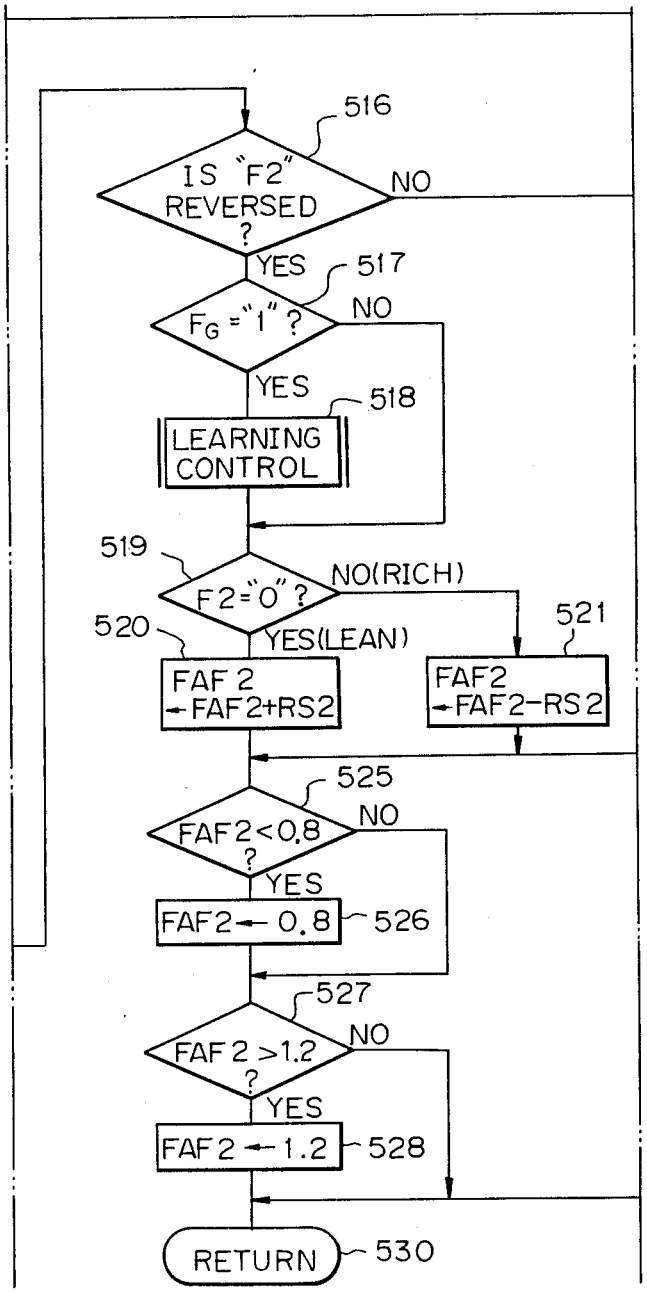
Figure 5C:
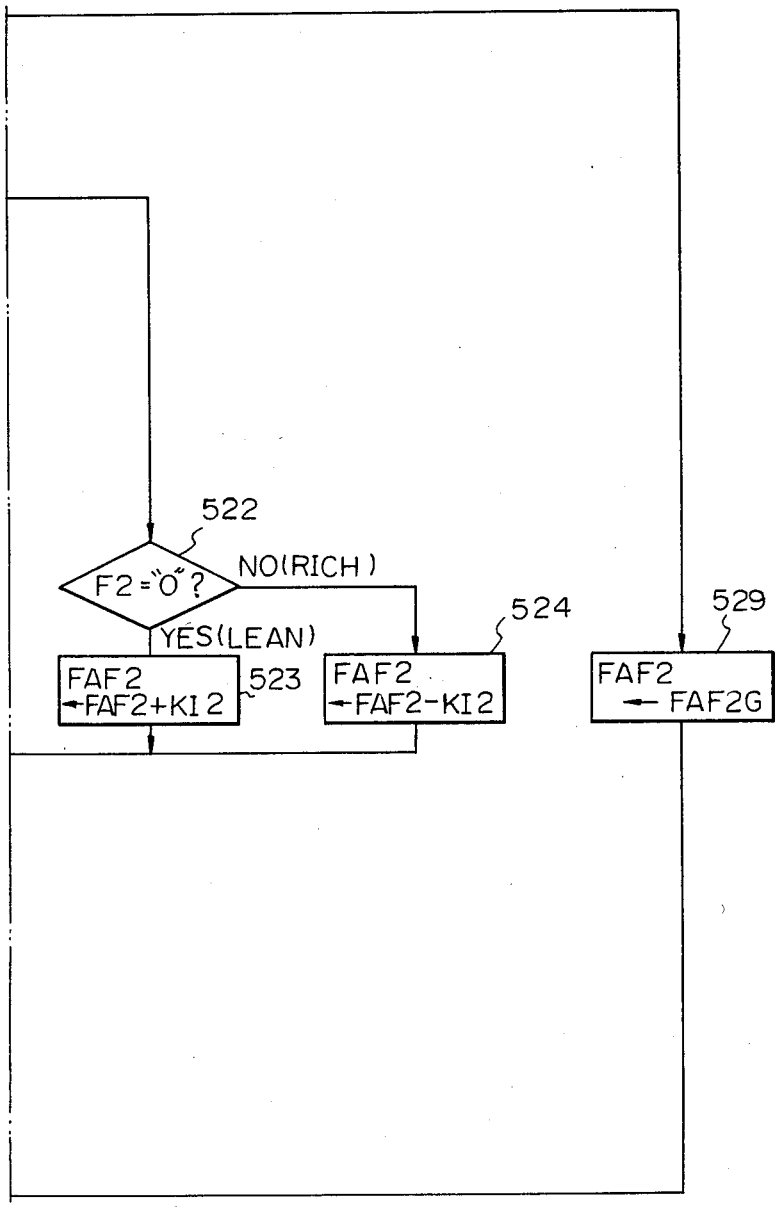

FIG. 5 is a routine for calculating a second air-fuel ratio feedback correction amount FAF2 in accordance with the output of the downstream-side $O_2$ sensor 15 executed at every predetermined time period such as 1 s.

At step 501, it is determined all the feedback control (closed-loop control) conditions by the downstream-side $O_2$ sensor 15 are satisfied. The feedback control conditions are as follows:

(i) the engine is not in a starting state;

(ii) the coolant temperature THW is higher than 50° C.; and (iii) the power fuel incremental amount FPOWER is 0.

Of course, other feedback control conditions are introduced as occasion demands. However, an explanation of such other feedback control conditions is omitted.

If one or more of the feedback control conditions is not satisfied, the control also proceeds to step 529, thereby carrying out an open-loop control operation. That is, at step 529, a learning value FAF2G of the second air-fuel ratio correction coefficient FAF2 is read out of the backup RAM 106, and the second air-fuel ratio correction coefficient FAF2 is made FAF2G.

Contrary to the above, at step 501, if all of the feedback control conditions are satisfied, the control proceeds to step 502.

At step 502, an A/D conversion is performed upon the output voltage $V_2$ of the downstream-side $O_2$ sensor 15, and the A/D converted value thereof is then fetched from the A/D converter 101. Then, at step 503, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 504 through 515 correspond to steps 304 through 315, respectively, of FIG. 3, thereby performing a delay operation upon the determination at step 503. Here, a rich delay time period is defined by TDR2, and a lean delay time period is defined by TDL2. As a result of the delayed determination, if the air-fuel ratio is rich a second air-fuel ratio flag F2 is made "1", and if the air-fuel ratio is lean, a second air-fuel ratio flag F2 is made "0".

Next, at step 516, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 517 to 521, which carry out a learning control operation and a skip operation.

At step 517, it is determined whether or not all the learning conditions are satisfied, i.e., a learning control execution flag $F_G$ is "1". Only if all the learning conditions are satisfied does the control proceed to step 518, which carries out a learning control operation. The steps 517 and 518 will be later explained with reference to FIGS. 6 and 7.

Steps 519 to 521 carry out a skip operation. That is, if the flag F2 is "0" (lean) at step 519, the control proceeds to step 520, which remarkably increases the second correction amount FAF2 by skip amount RS2. Also, if the flag F2 is "1" (rich) at step 519, the control proceeds to step 521, which remarkably decreases the second correction amount FAF2 by the skip amount RS2.

On the other hand, if the second air-fuel ratio flag F2 is not reversed at step 516, the control proceeds to steps 522 to 524, which carries out an integration operation. That is, if the flag F2 is "0" (lean) at step 522, the control proceeds to step 523, which gradually increases the second correction amount FAF2 by an integration amount KI2. Also, if the flag F2 is "1" (rich) at step 522, the control proceeds to step 523, which gradually decreases the second correction amount FAF2 by the integration amount KI2.

Note that the skip amount RS2 is larger than the integration amount KI2.

The second correction amount FAF2 is guarded by a minimum value 0.8 at steps 525 and 526, and by a maximum value 1.2 at steps 527 and 528, thereby also preventing the controlled air-fuel ratio from becoming overrich or overlean.

The correction amount FAF2 is then stored in the RAM 105, thus completing this routine of FIG. 5 at step 530.

Figure 6:
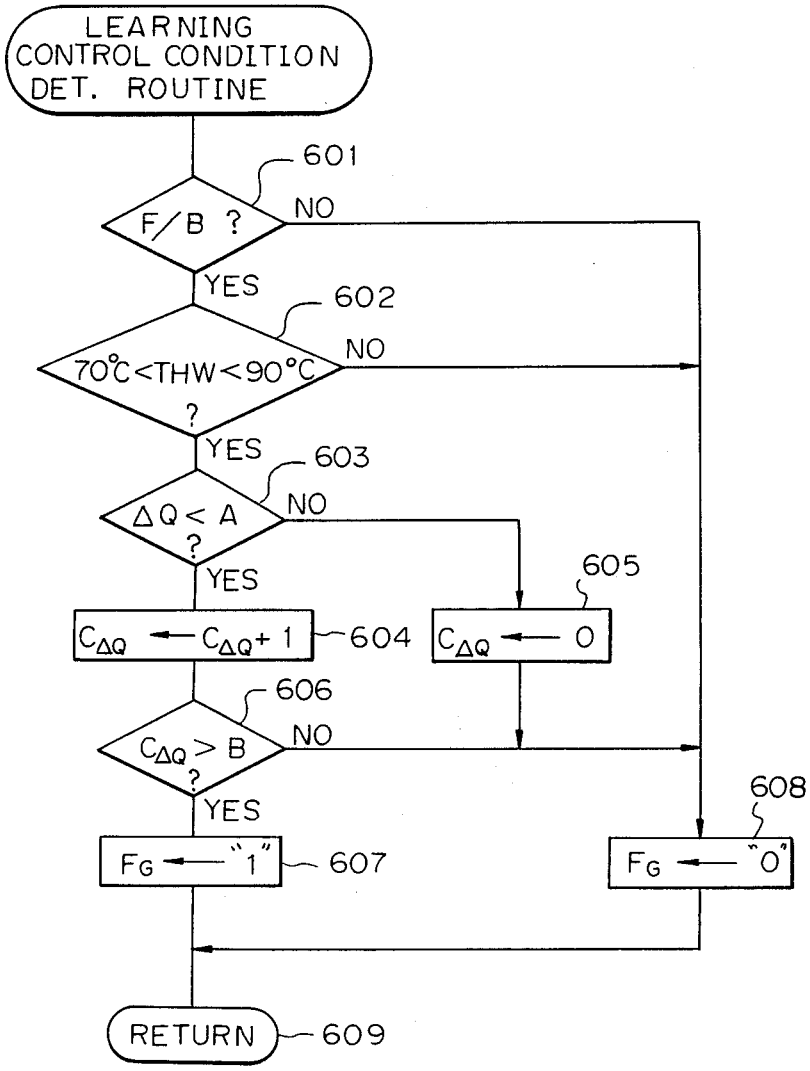

FIG. 6 is a routine for calculating the learning control execution flag $F_G$, executed at every predetermined time period such as 1 s or at every predetermined crank angle such as 180° CA. At step 601, it is determined whether or not all the air-fuel ratio feedback conditions for the two $O_2$ sensors 13 and 15 are satisfied, i.e., whether or not all the conditions at steps 301 and 501 of FIGS. 3 and 5 are satisfied. Only if all the conditions at steps 301 and 501 are satisfied does the control proceed to step 602, which reads the coolant temperature data THW from the RAM 105 and determines whether or not $$70° \text{ C.} < THW < 90° \text{ C.}$$

Only if 70° C.<THW<90° C., which means that the coolant temperature THW is stable, does the control proceed to step 603. At step 603, it is determined whether or not a change ΔQ of the intake air amount Q per 1 s of 180° CA is smaller than a predetermined value A. As a result, if ΔQ<A, the control proceeds to step 604 which counts up a counter $C_{\Delta Q}$. Otherwise, the counter $C_{\Delta Q}$ is reset by step 605. Further, at step 606, it is determined whether or not $C_{\Delta Q}>B$ (definite value). As a result, only if $C_{\Delta Q}>B$ does the control proceed to step 607, which sets the learning control execution flag $F_G$. Otherwise, the learning control execution flag $F_G$ is reset at step 608. Thus, the routine of FIG. 6 is completed by step 609.

Thus, according to the routine of FIG. 6, under the conditions that the air-fuel ratio feedback controls by the two $O_2$ sensors 13 and 15 are carried out, only when the coolant temperature THW is stable, and in addition, the change of the engine load parameter such as the intake air amount Q is stable, is the learning control execution flag $F_G$ set, thereby carrying out a learning control.

Note, other learning control conditions can be introduced as occasion demands.

Figure 7:
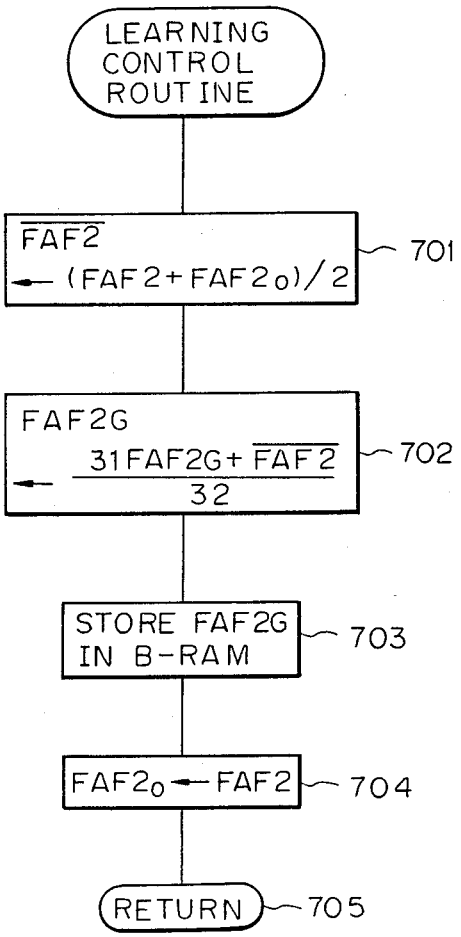

FIG. 7 is a detailed routine of the learning control step 518 of FIG. 5. As explained above, this routine is carried out when the delayed output of the downstream-side $O_2$ sensor 15 is reversed and all the learning conditions are satisfied. At step 701, a mean value $\overline{FAF2}$ of the second air-fuel ratio correction coefficient FAF2 is calculated by $$FAF2 \leftarrow (FAF2 + FAF2_0)/2$$

where $FAF2_0$ is a value of the second air-fuel ratio correction coefficient FAF2 fetched previously at a skip operation. That is, the mean value FAF2 is a mean value of two successive values of the second air-fuel ratio correction coefficient FAF2 immediately before the skip operation. Next, at step 702, the learning value FAF2G of the second air-fuel ratio correction coefficient FAF2 is obtained by $$FAF2G \leftarrow \frac{31\ FAF2G + \overline{FAF2}}{32}$$

That is, the learning value FAF2G is a blunt value of the mean value $\overline{FAF2}$ of the second air-fuel ratio correction coefficient FAF2. Then, at step 703, the learning value FAF2G is stored in the backup RAM 106, and at step 704, in order to prepare the next execution, $$FAF2_0 \leftarrow FAF2$$

Thus, the routine of FIG. 7 is completed by step 705.

Note that, in FIG. 7, step 702 can be deleted, and in this case, the learning value $\overline{FAF2G}$ is made the mean value $\overline{FAF2}$.

Thus, a learning control operation is performed upon the second air-fuel ratio correction coefficient FAF2 and the obtained learning value FAF2G is used as the second air-fuel ratio correction amount FAF2 at the start of the air-fuel ratio feedback control by the downstream-side $O_2$ sensor 15.

Figure 8:
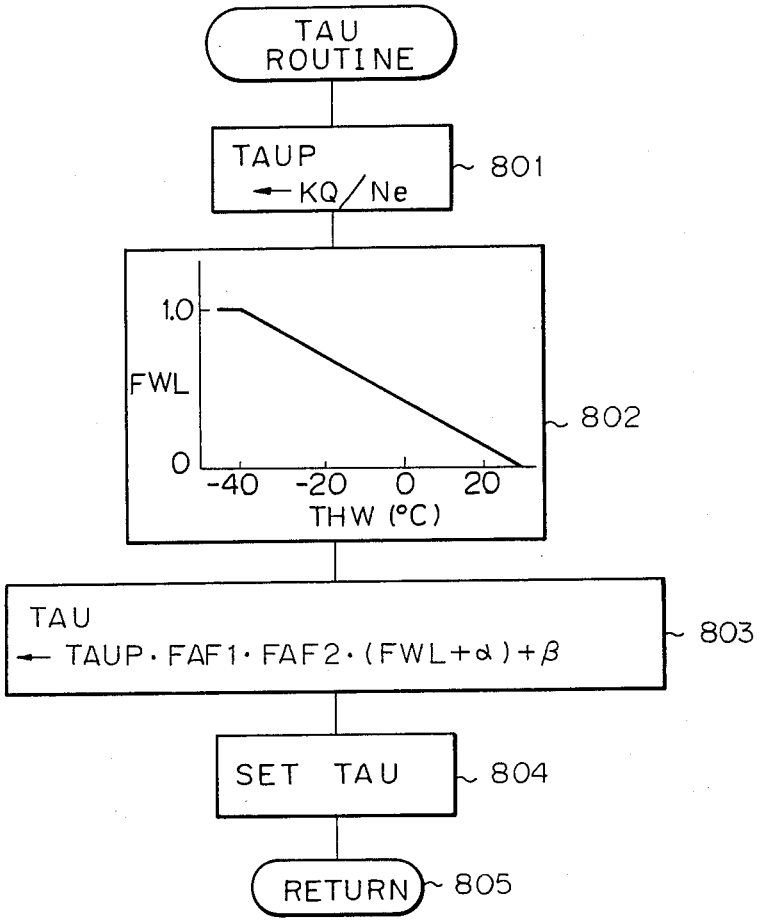

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $$TAUP \leftarrow KQ/Ne$$

where K is a constant. Then at step 802, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 803, a final fuel injection amount TAU is calculated by $$TAU \leftarrow TAUP \cdot FAF1 \cdot FAF2 \cdot (FWL + \alpha) + \beta$$

Where $\alpha$ and $\beta$ are correction factors determined by other parameters such as the voltage of the battery and the temperature of the intake air. At step 803, the final fuel injection amount TAU is set in the down counter 107, and in addition, the flip-flop 108 is set initiate the activation of the fuel injection valve 7. Then, this routine is completed by step 804. Note that, as explained above, when a time period corresponding to the amount TAU passes, the flip-flop 109 is reset by the carry-out signal of the down counter 108 to stop the activation of the fuel injection valve 7.

Figures 9A, 9B, 9C, 9D, 9E, 9F, 9G, 9H:
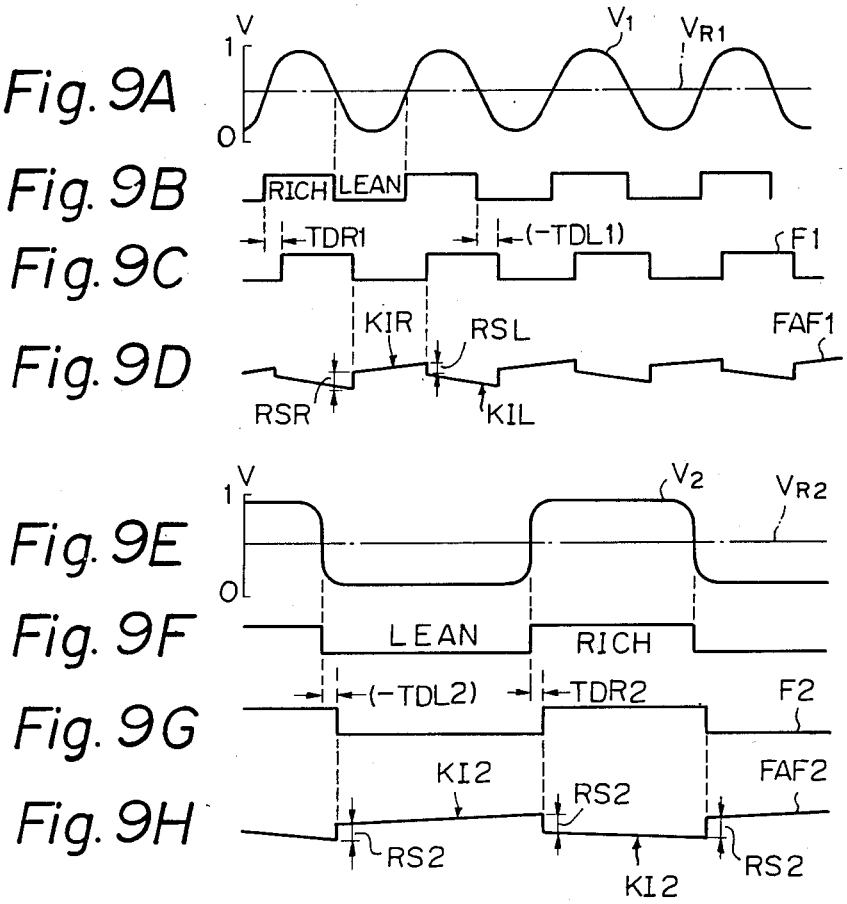
FIGS. 9A through 9H, 10A, and 10B are timing diagrams explaining the flow charts of FIGS. 3, 3A–3C, 5, 5A–5C, 6, 7, and 8.

FIG. 9A through 9H are timing diagrams for explaining the two air-fuel ratio correction amounts FAF1 and FAF2 obtained by the flow charts of FIGS. 3, 5, 6, 7, and 8. In this case, the engine is in a closed-loop control state for the two $O_2$ sensors 13 and 15. When the output of the upstream-side $O_2$ sensor 13 is changed as illustrated in FIG. 9A, the determination at step 303 of FIG. 3 is shown in FIG. 9B, and a delayed determination thereof corresponding to the first air-fuel ratio flag F1 is shown in FIG. 9C. As a result, as shown in FIG. 9D, every time the delayed determination is changed from the rich side to the lean side, or vice versa, the first air-fuel ratio correction amount FAF1 is skipped by the amount RSR or RSL. On the other hand, when the output of the downstream-side $O_2$ sensor 15 is changed as illustrated in FIG. 9E, the determination at step 903 of FIG. 5 is shown in FIG. 9F, and the delayed determination thereof corresponding to the second air-fuel ratio flag F2 is shown in FIG. 9G. As a result, as shown in FIG. 9H, every time the delayed determination is changed from the rich side to the lean side, or vice versa, the second air-fuel ratio correction amount FAF2 is skipped by the skip amount RS2.

Figures 10A, 10B:
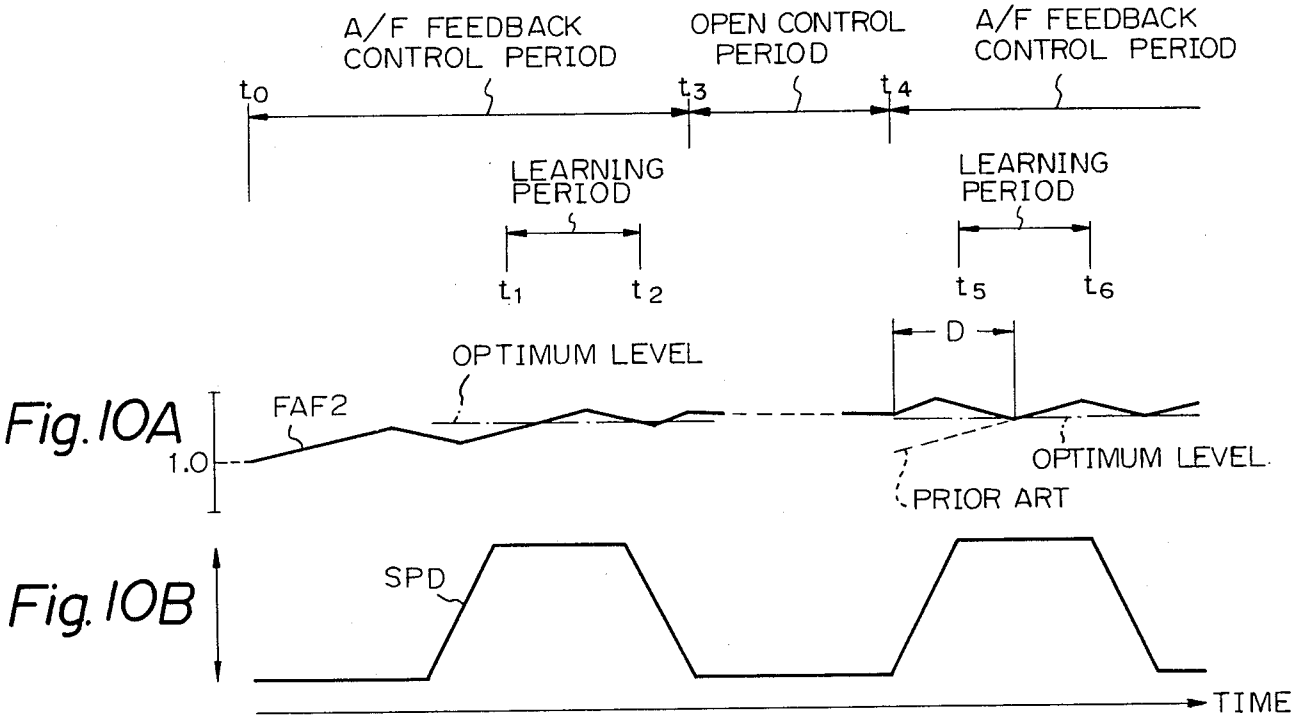
Figure 11A:
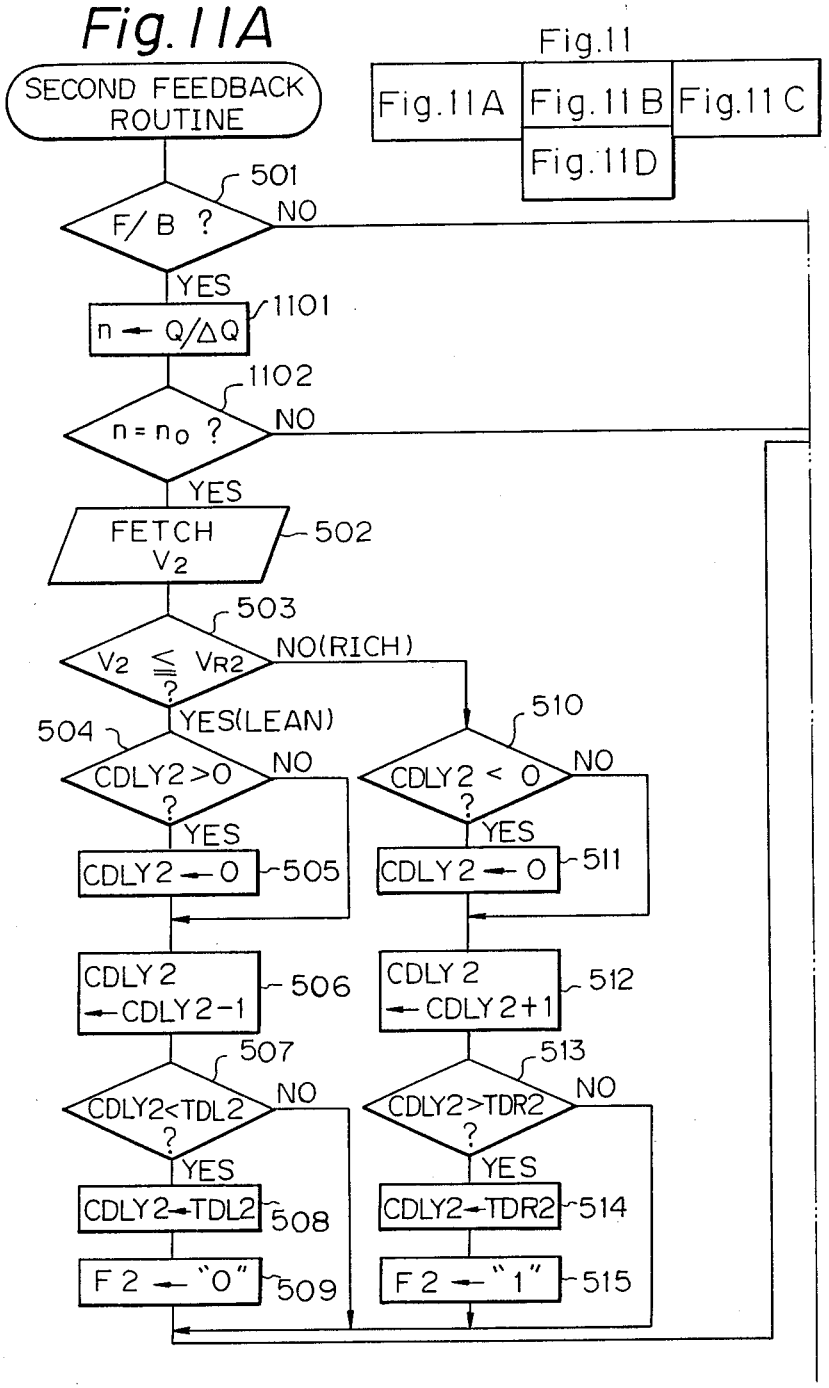
Figure 11B:
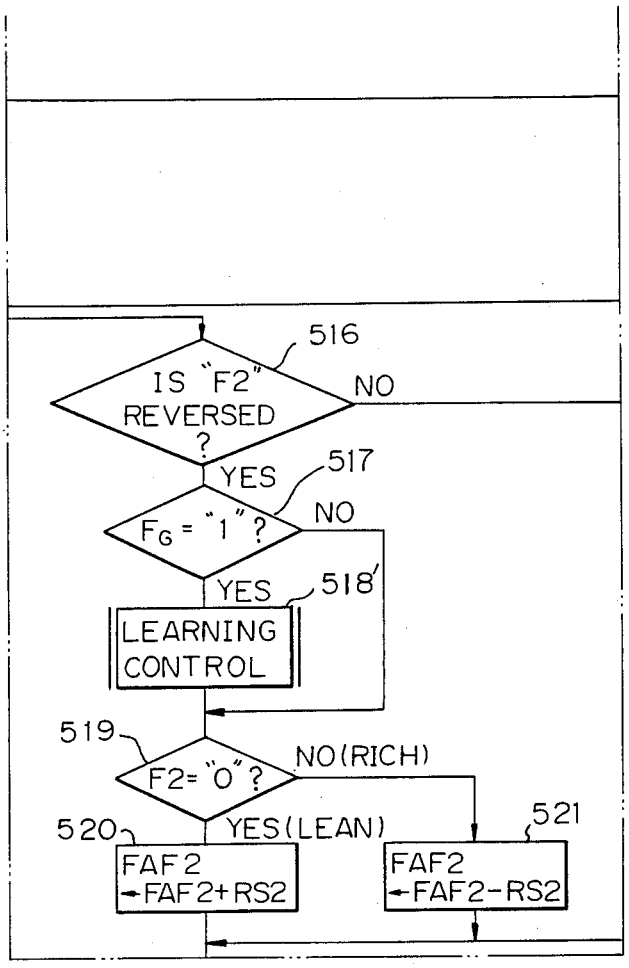
Figure 11C:
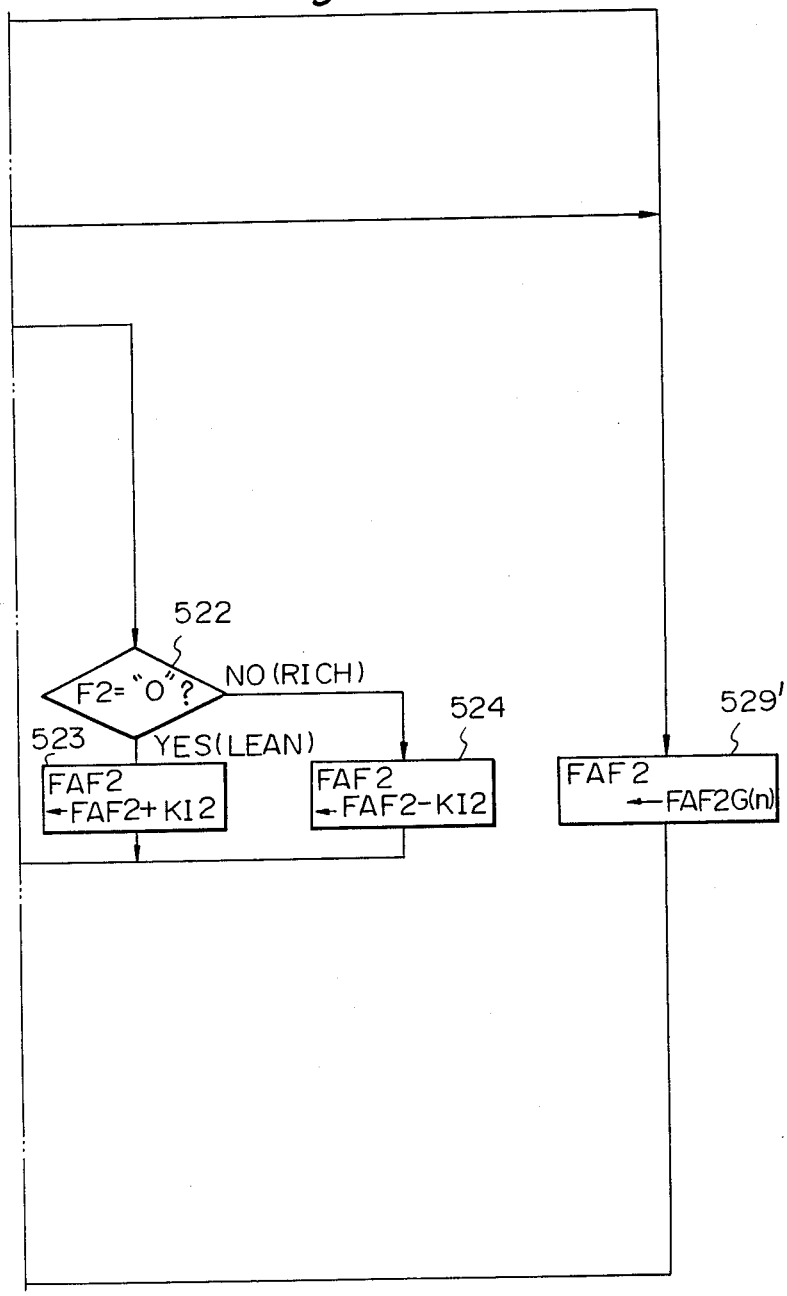
Figure 11D:
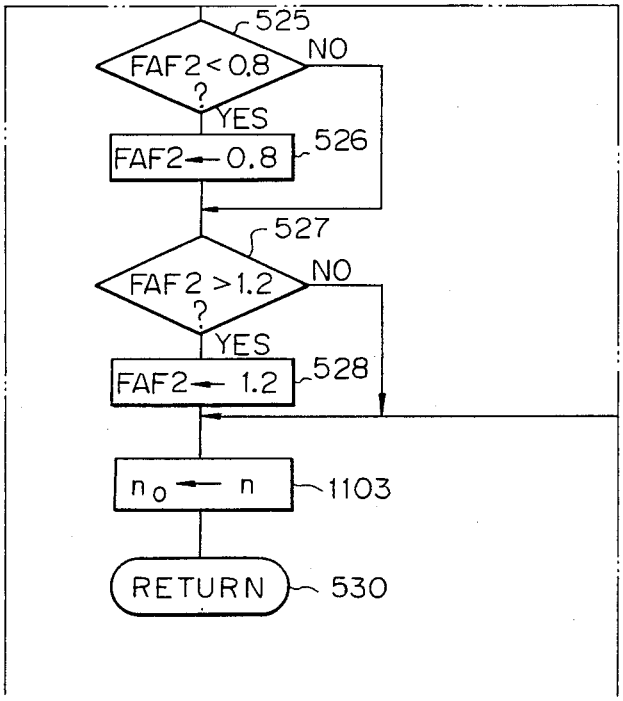

FIGS. 10A and 10B are also timing diagrams for explaining the second air-fuel ratio correction amount FAF2 obtained by the flow charts of FIGS. 3, 5, 6, 7, and 8. When the vehicle speed SPD is changed as shown in FIG. 10B, the air-fuel ratio feedback control by the downstream-side $O_2$ sensor 15 is initiated at time $t_0$, so that the second air-fuel ratio correction coefficient FAF2 is brought close to an optimum level. Also, during a time period from $t_1$ to $t_2$, a learning control operation is carried out, and accordingly, a learning value FAF2G of the second air-fuel ratio correction coefficient FAF2 is calculated. As a result, at time $t_3$, when the engine is stopped, the control enters into an open control state. Then, at time $t_4$, when the control again enters into an air-fuel ratio feedback control state, the second air-fuel ratio correction coefficient FAF2 promptly reaches an optimum level, since this coefficient FAF2 starts from the learning value FAF2G at time $t_4$.

Note that, in the prior art, since a learning operation is not performed upon the second air-fuel ratio correction coefficient FAF2, this coefficient FAF2 starts from a definite value such as 1.0 as indicated in FIG. 10A, and accordingly, it takes a long time D for the coefficient FAF2 to reach an optimum level. This delayed time D causes a deterioration of the fuel consumption, the drivability, and the conditions of the exhaust emissions.

In FIG. 11, which is a modification of FIG. 5, steps 1101, 1102, and 1103 are added to FIG. 5, and steps 518 and 529 are modified to steps 518' and 529', respectively. That is, at step 501, if the air-fuel ratio feedback control conditions by the downstream-side $O_2$ sensor 15 are satisfied, the control proceeds to step 1101, which reads the intake air amount data Q and calculates $$n \leftarrow Q/\Delta Q$$

where $\Delta Q$ is a constant. Note that n is an integer, and accordingly, fractions of $Q/\Delta Q$ are omitted. Thus, the engine state is divided into a plurality of driving regions n:

$$\begin{aligned} &\text{region 0:} && 0 \leqq Q < \Delta Q \\ &\text{region 1:} && \Delta Q \leqq Q < 2\Delta Q \\ &\quad\vdots \\ &\text{region } K: && k\Delta Q \leqq Q < (k+1)\Delta Q \\ &\quad\vdots \end{aligned}$$

At step 1102, it is determined whether or not the current driving region n is the same as the previous driving region $n_0$. As a result, if $n = n_0$, the control proceeds to step 1102. Otherwise, the control proceeds to step 529'.

Therefore, when the air-fuel ratio feedback control conditions by the downstream-side $O_2$ sensor 15 are not satisfied, or when the driving region n is changed, at step 529', the second air-fuel ratio correction coefficient FAF2 is made the learning value FAF2G(n) for the corresponding driving region n. Note that the learning values FAF2G(n) are stored in the backup RAM 106 as follows:

| n | FAF2G |
|---|---|
| 0 | FAF2G (0) |
| 1 | FAF2G (1) |
| . | . |
| . | . |
| k | FAF2G (k) |
| . | . |
| . | . |

Note that step 1103 stores the driving region n as the previous driving region $n_0$ in the RAM 105 in order to execute the next operation.

Figure 12:
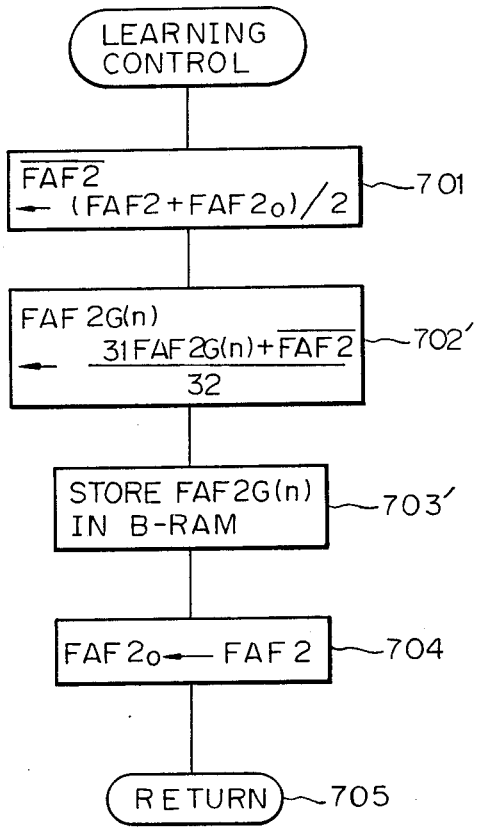

The learning control step 518' will be explained with reference to FIG. 12. As explained above, this routine is carried out when the driving region n is unchanged and the delayed output of the downstream-side $O_2$ sensor 15 is reversed under the condition that all of the learning conditions are satisfied. In FIG. 12, steps 702 and 703 of FIG. 7 are modified to steps 702' and 703', respectively. That is, at step 702', the learning value FAF2(n) for the current driving region n is renewed by $$FAF2G(n) \leftarrow \frac{31\ FAF2G(n) + \overline{FAF2}}{32}$$

Where $\overline{FAF2}$ is a mean value of the second air-fuel ratio correction coefficient FAF2 calculated at step 701. Then, at step 703', the learning value FAF2G(n) is stored in the corresponding area of the backup RAM 106.

Figures 13A, 13B:
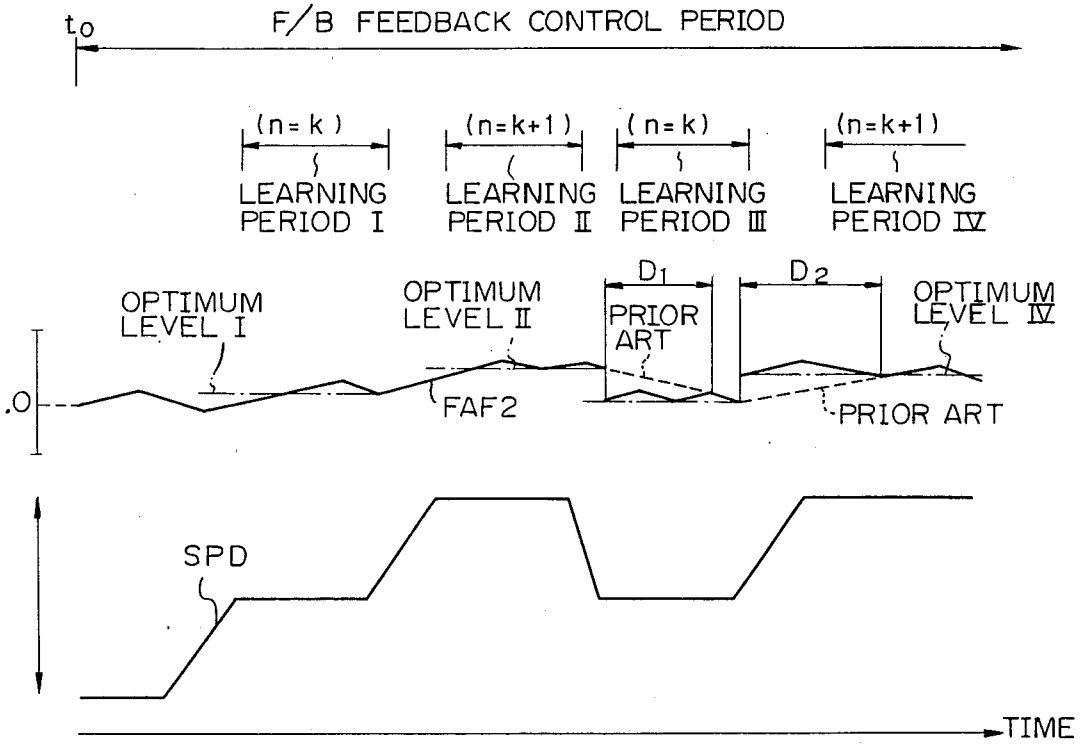
FIGS. 13A and 13B are timing diagrams explaining the flow charts of FIGS. 3, 3A–3C, 6, 8, 11, 11A–11D, and 12.

FIGS. 13A and 13B are timing diagrams for explaining the second air-fuel ratio correction amount FAF2 obtained by the flow charts of FIGS. 3, 6, 8, 11, and 12. That is, the routines of FIGS. 11 and 12 are used instead of those of FIGS. 5 and 7. In FIGS. 13A and 13B, the air-fuel ratio feedback control by the downstream-side $O_2$ sensor 15 is carried out after time $t_0$. When the vehicle speed SPD is changed as shown in FIG. 13B, the driving region n is changed and accordingly, the optimum level of the second air-fuel ratio feedback correction coefficient FAF2 is also changed (see I→II→III→IV). As a result, as shown in FIG. 13A, the second air-fuel ratio correction coefficient FAF2 is brought close to a corresponding optimum level by the air-fuel ratio feedback control by the downstream-side $O_2$ sensor 15. Further, during each learning time period I, II, III, or IV, a learning control operation is carried out, thereby renewing the learning value FAF2G(n). Here, if the optimum levels I and III belong to the same driving region n (=k), and the optimum levels II and IV belong to the same driving region n (=k+1), the learning value FAF2G(k) is used for the second air-fuel ratio correction coefficient FAF2 at the transition from the learning time period II to the learning time period III, and the learning value FAF2G (k+1) is used for the second air-fuel ratio correction coefficient FAF2 at the transition from the learning time period III to the learning time period IV. Therefore, in an air-fuel ratio feedback control state by the downstream-side $O_2$ sensor 15, even when the driving region n is changed, the second air-fuel ratio correction coefficient FAF2 promptly reaches a corresponding optimum level. Of course, even when the engine goes from an open control into an air-fuel ratio feedback control by the downstream-side $O_2$ sensor 15, the second air-fuel ratio correction coefficient FAF2 promptly reaches a corresponding optimum level, since this coefficient FAF2 also starts from the corresponding learning value FAF2G(n).

Note that, as indicated by a dotted line in FIG. 13A, when the second air-fuel ratio correction coefficient FAF2 is changed only by the air-fuel ratio feedback control of the downstream-side $O_2$ sensor 15, and the driving region n is changed, it takes a long time $D_1$ or $D_2$ for the coefficient FAF2 to reach a corresponding optimum level. This delay time $D_1$ or $D_2$ causes a deterioration of the fuel consumption, the drivability, and the conditions of the exhaust emissions.

A double $O_2$ sensor system, in which an air-fuel ratio feedback control parameter of the first air-fuel ratio feedback control by the upstream-side $O_2$ sensor is variable, will be explained with reference to FIGS. 14, 15, and 16. In this case, the skip amounts RSR and RSL as the air-fuel ratio feedback control parameters are variable.

Figures 14, 14A:
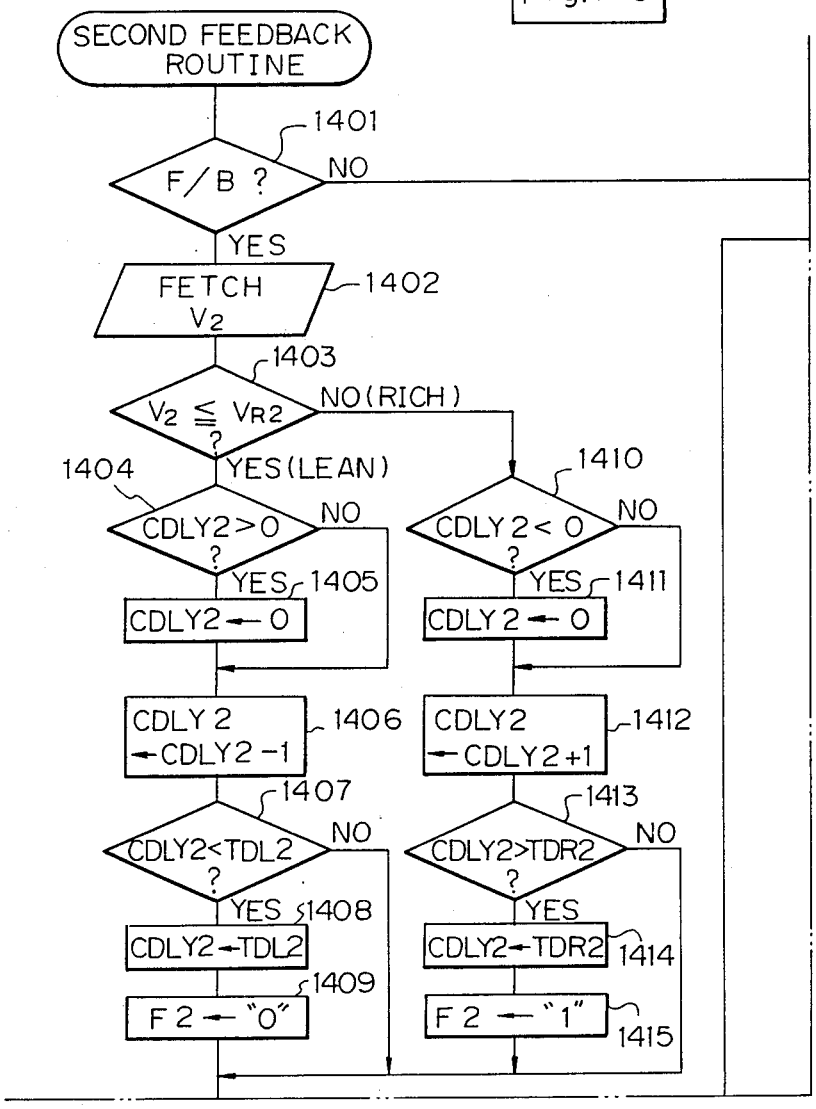
Figure 14B:
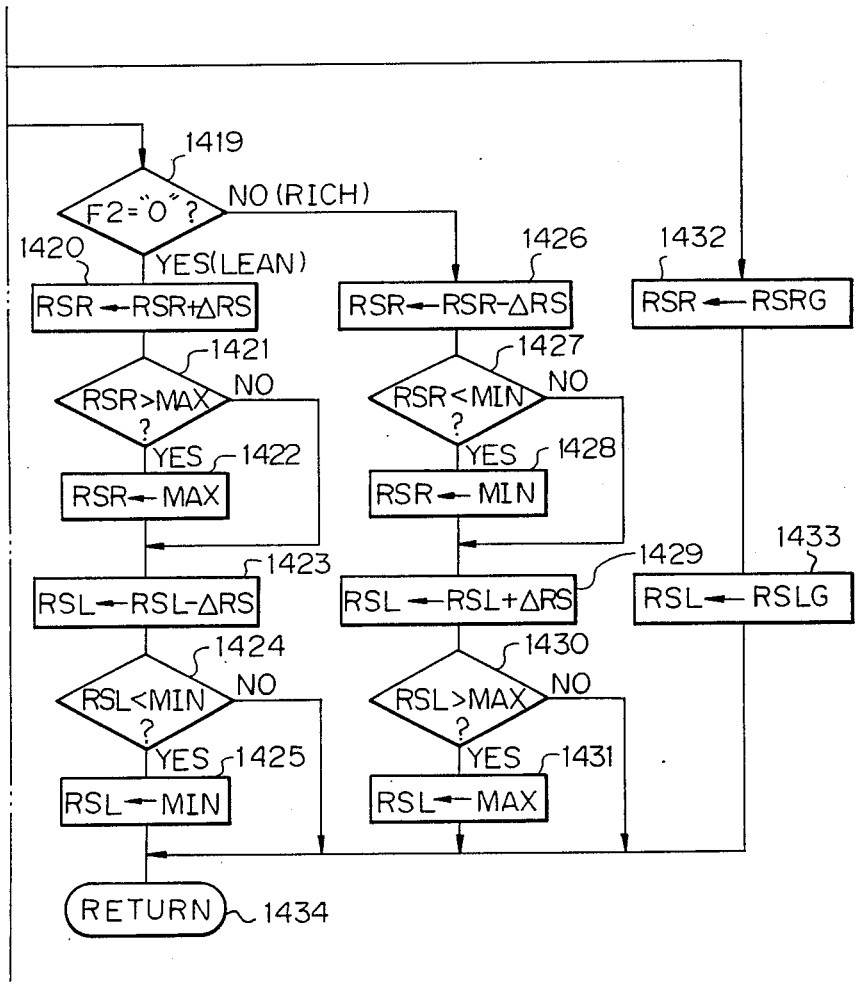
Figure 14C:
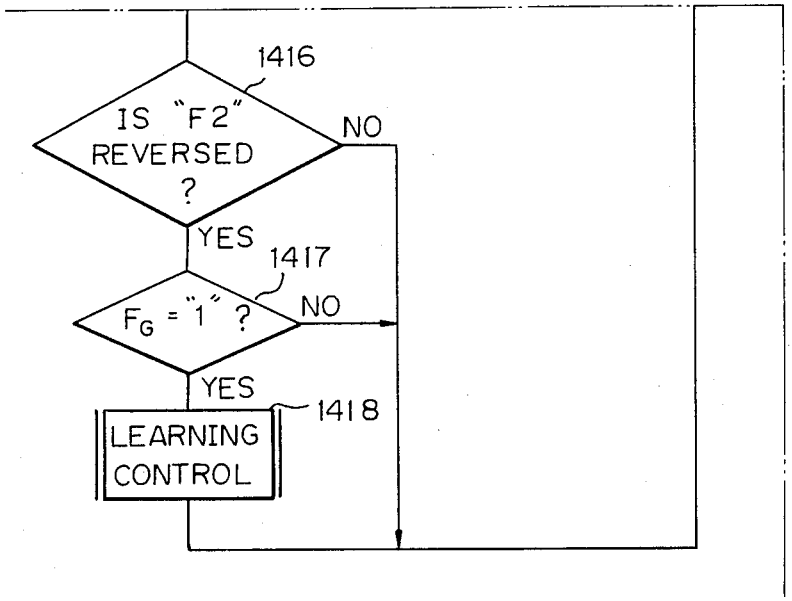

FIG. 14 is a routine for calculating the skip amounts RSR and RSL in accordance with the output of the downstream-side $O_2$ sensor 15 executed at every predetermined time period such as 1 s.

Steps 1401 through 1415 are the same as steps 501 through 515 of FIG. 5. That is, if one or more of the feedback control conditions is not satisfied, the control proceeds to steps 1432 and 1433, thereby carrying out an open-loop control operation. That is, at steps 1432 and 1433, learning values RSRG and RSLG of the rich skip amount RSR and the lean skip amount RSL is read out of the backup RAM 106, and the amounts RSR and RSL are made RSRG and RSLG, respectively.

Contrary to the above, at step 1401, if all of the feedback control conditions are satisfied, the control proceeds to step 1402. Steps 1402 through 1415 correspond to steps 502 to 515, respectively, of FIG. 5. That is, the determination result at step 1403 is delayed by steps 1404 through 1415.

Next, at step 1416, it is determined whether or not the second air-fuel ratio flag F2 is reversed, i.e., whether or not the delayed air-fuel ratio detected by the downstream-side $O_2$ sensor 15 is reversed. If the second air-duel ratio flag F2 is reversed, the control proceeds to step 1419 which determines whether or not all the learning conditions are satisfied, i.e., the learning control execution flag $F_G$ is "1". Only if all the learning conditions are satisfied does the control proceeds to step 1418, which carries out a learning control operation. Note that the learning control execution flag $F_G$ is also determined by the routine of FIG. 6. Step 1418 will be later explained with reference to FIG. 15.

At step 1419, it is determined whether or not the second air-fuel ratio F2 is "0". If F2="0", which means that the air-fuel ratio is lean, the control proceeds to steps 1420 through 1425, and if F2 ="1", which means that the air-fuel ratio is rich, the control proceeds to steps 1426 through 1431.

At step 1420, the rich skip amount RSR is increased by a definite value ΔRS which is, for example, 0.08, to move the air-fuel ratio to the rich side. At steps 1421 and 1422, the rich skip amount RSR is guarded by a maximum value MAX which is, for example, 7.5%. Further, at step 1423, the lean skip amount RSL is decreased by the definite value ΔRS to move the air-fuel ratio to the lean side. At steps 1424 and 1425, the lean skip amount RSL is guarded by a minimum value MIN which is, for example 2.5%.

On the other hand, at step 1426, the rich skip amount RSR is decreased by the definite value ΔRS to move the air-fuel ratio to the lean side. At steps 1427 and 1428, the rich skip amount RSR is guarded by the minimum value MIN. Further, at step 1429, the lean skip amount RSL is decreased by the definite value ΔRS to move the air-fuel ratio to the rich side. At steps 1430 and 1431, the lean skip amount RSL is guarded by the maximum value MAX.

The skip amounts RSR and RSL are then stored in the RAM 105, thereby completing this routine of FIG. 14 at step 1434.

Thus, according to the routine of FIG. 14, when the delayed output of the second $O_2$ sensor 15 is lean, the rich skip amount RSR is gradually increased, and the lean skip amount RSL is gradually decreased, thereby moving the air-fuel ratio to the rich side. Contrary to this, when the delayed output of the second $O_2$ sensor 15 is rich, the rich skip amount RSR is gradually decreased, and the lean skip amount RSL is gradually increased, thereby moving the air-fuel ratio to the lean side. Also, in an open-loop control state, the skip amounts RSR and RSL are made the corresponding learning values RSRG and RSLG, respectively.

Figure 15:
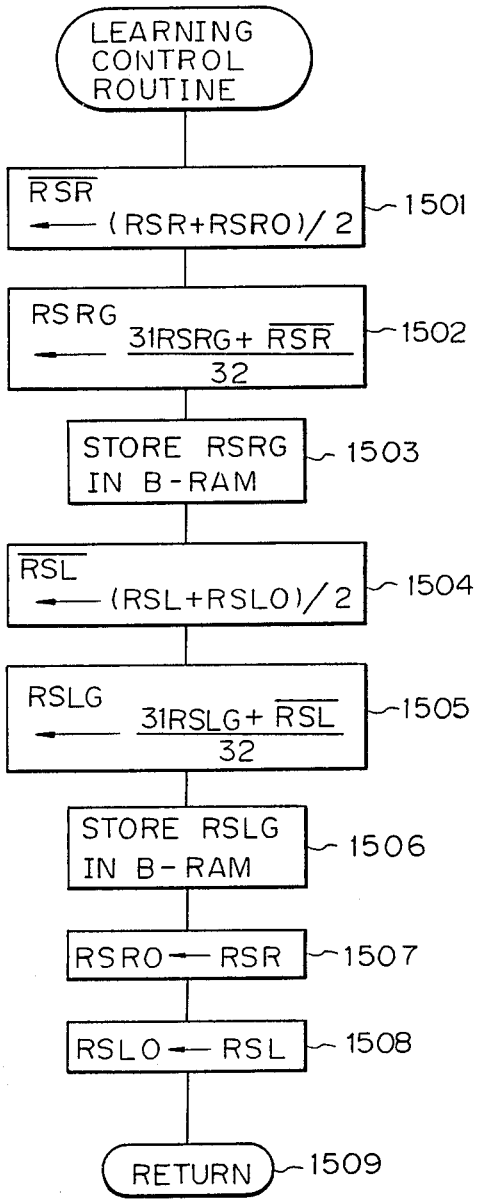

FIG. 15 is a detailed routine of the learning control step 1418 of FIG. 14. As explained above, this routine is carried out when the delayed output of the downstream-side $O_2$ sensor 15 is reversed and all of the learning conditions are satisfied. At step 1501, a mean value $\overline{RSR}$ of the rich skip amount RSR is calculated by $$\overline{RSR} \leftarrow (RSR + RSRO)/2$$

Where RSRO is a value of the rich skip amount RSR fetched previously at a skip operation. That is, the mean value RSR is a mean value of two successive values of the rich skip amount RSR immediately before the skip operations. Next, at step 1502, the learning value RSRG of the rich skip amount RSR is obtained by $$RSRG \leftarrow \frac{31\ RSRG + \overline{RSR}}{32}.$$

That is, the learning value RSRG is a blunt value of the mean value RSR of the rich skip amount RSR. Then, at step 1503, the learning value RSRG is stored in the backup RAM 106.

Similarly, at step 1504, a mean value $\overline{RSL}$ of the lean skip amount RSL is calculated by $$\overline{RSL} \leftarrow (RSL + RSLO)/2$$

Where RSLO is a value of the lean skip amount RSL fetched previously at a skip operation. That is, the mean value $\overline{RSL}$ is a mean value of two successive values of the lean skip amount RSL immediately before the skip operations. Next, at step 1505, the learning value RSLG of the lean skip amount RSL is obtained by $$RSLG \leftarrow \frac{31\ RSLG + \overline{RSL}}{32}.$$

That is, the learning value RSLG is a blunt value of the mean value $\overline{RSL}$ of the lean skip amount RSL. Then, at step 1506, the learning value RSLG is stored in the backup RAM 106.

At steps 1507 and 1508, in order to prepare the next operation, $$RSRO \leftarrow RSR$$

$$RSLO \leftarrow RSL.$$

Thus, this routine of FIG. 15 is completed by step 1509.

Note that, also in FIG. 15, steps 1502 and 1505 can be deleted, and in this case, the learning values RSRG and RSLG are made the mean values $\overline{RSR}$ and $\overline{RSL}$, respectively.

Thus, a learning control operation is performed upon the skip amounts RSR and RSL, and the obtained learning values RSRG and RSLG are used as the skip amounts RSR and RSL at the start of the air-fuel ratio feedback control by the downstream-side $O_2$ sensor 15.

Figure 16:
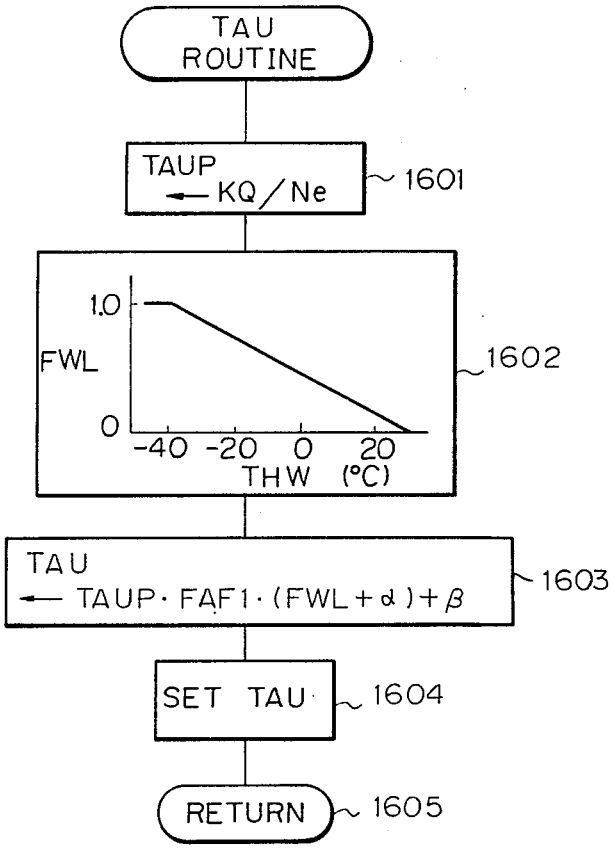

FIG. 16 is a routine for calculating a fuel injection amount TAU executed at every predetermined crank angle such as 360° CA. At step 1601, a base fuel injection amount TAUP is calculated by using the intake air amount data Q and the engine speed data Ne stored in the RAM 105. That is, $$TAUP \leftarrow KQ/Ne$$

Where K is a constant. Then at step 1602, a warming-up incremental amount FWL is calculated from a one-dimensional map by using the coolant temperature data THW stored in the RAM 105. Note that the warming-up incremental amount FWL decreases when the coolant temperature THW increases. At step 1603, a final fuel injection amount TAU is calculated by $$TAU \leftarrow TAUP \cdot FAF1 \cdot (FWL + \alpha) + \beta$$

Where $\alpha$ and $\beta$ are correction factors determined by other parameters such as the voltage of the battery and the temperature of the intake air. At step 1604, the final fuel injection amount TAU is set in the down counter 108, and in addition, the flip-flop 109 is set to initiate the activation of the fuel injection valve 7. Then, this routine is completed by step 1605. Note that, as explained above, when a time period corresponding to the amount TAU has passed, the flip-flop 109 is reset by the carry-out signal of the down counter 108 to stop the activation of the fuel injection valve 7.

Figures 17A, 17B, 17C, 17D, 17E, 17F, 17G, 17H, 17I:
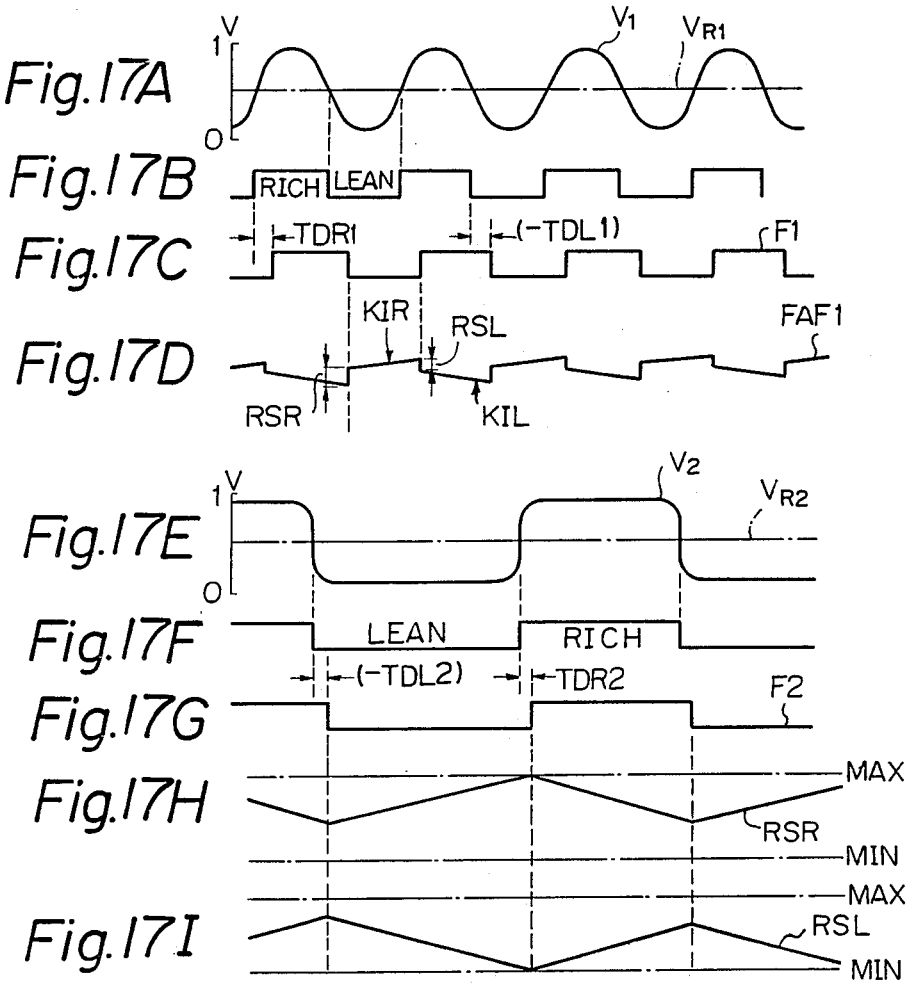
FIGS. 17A through 17I, 18A, and 18B are timing diagrams explaining the flow charts of FIGS. 3, 3A–3C, 6, 14, 14A–14C, 15, and 16.

FIGS. 17A through 17I are timing diagrams for explaining the air-fuel ratio correction amount FAF1 and the skip amounts RSR and RSL obtained by the flow charts of FIGS. 3, 6, 12, 14, and 15. FIGS. 17A through 17G are the same as FIGS. 9A through 9G, respectively. As shown in FIGS. 17H and 17I, when the delayed determination F2 is lean, the rich skip amount RSR is increased and the lean skip amount RSL is decreased, and when the delayed determination F2 is rich, the rich skip amount RSR is decreased and the lean skip amount RSL is increased. In this case, the skip amounts RSR and RSL are changed within a range from MAX to MIN.

Figures 18A, 18B:
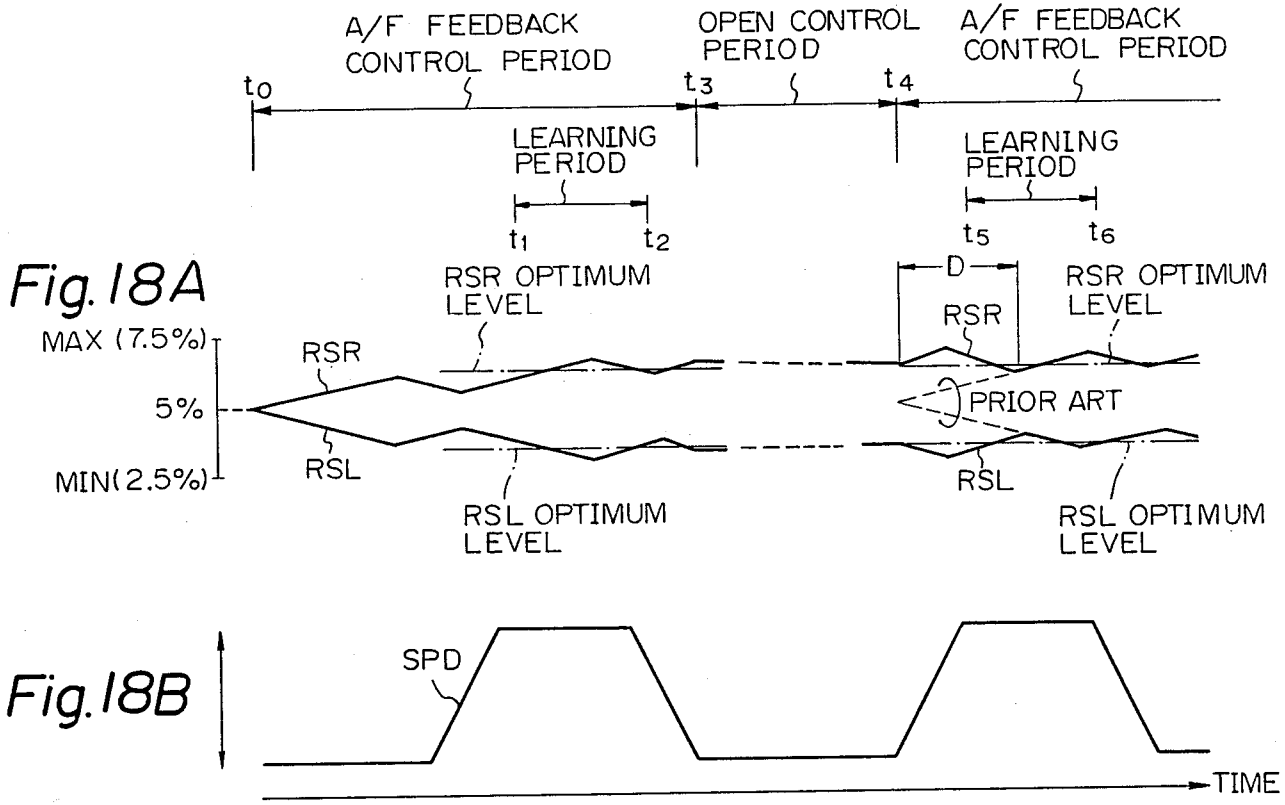

FIGS. 18A and 18B are also timing diagrams for explaining the skip amounts RSR and RSL obtained by the flow charts of FIGS. 3, 6, 12, 14, and 15. When the vehicle speed SPD is changed as shown in FIG. 18B, the air-fuel ratio feedback control by the downstream-side $O_2$ sensor 15 is initiated at time $t_0$, so that the skip amounts RSR and RSL are brought close to their optimum level. Also, during a time period from $t_1$ to $t_2$, a learning control operation is carried out, and accordingly, learning values RSRG and RSLG of the skip amounts RSR and RSL are calculated. As a result, at time $t_3$, when the engine is stopped, the control enters into an open control state. Then, at time $t_4$, when the control again enters into an air-fuel ratio feedback control state, the skip amounts RSR and RSL promptly reach their optimum levels, since these skip amounts RSR and RSL start from the learning values RSRG and RSLG, respectively, at time $t_4$.

Note that, in the prior art, since a learning operation is not performed upon the skip amounts RSR and RSL, these skip amounts RSR and RSL start from a definite value such as 5% as indicated in FIG. 18A, and accordingly, it takes a long time D for the skip amounts RSR and RSL to reach their optimum levels. This delay time D causes a deterioration of the fuel consumption, the drivability, and the conditions of the exhaust emissions.

Figures 19, 19A:
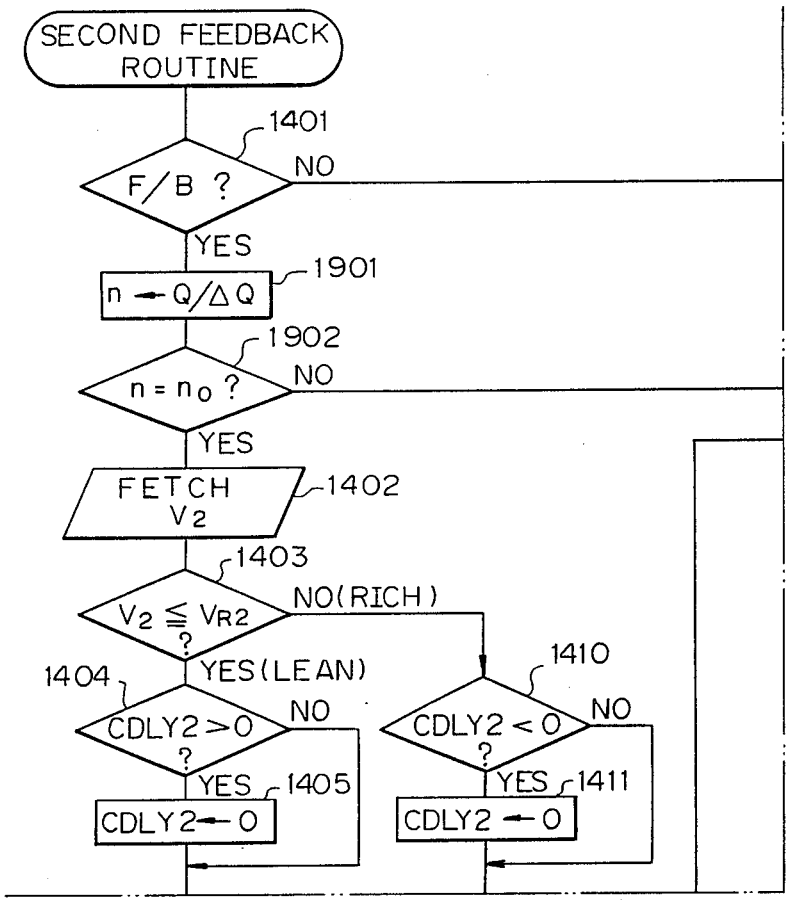
Figure 19B:
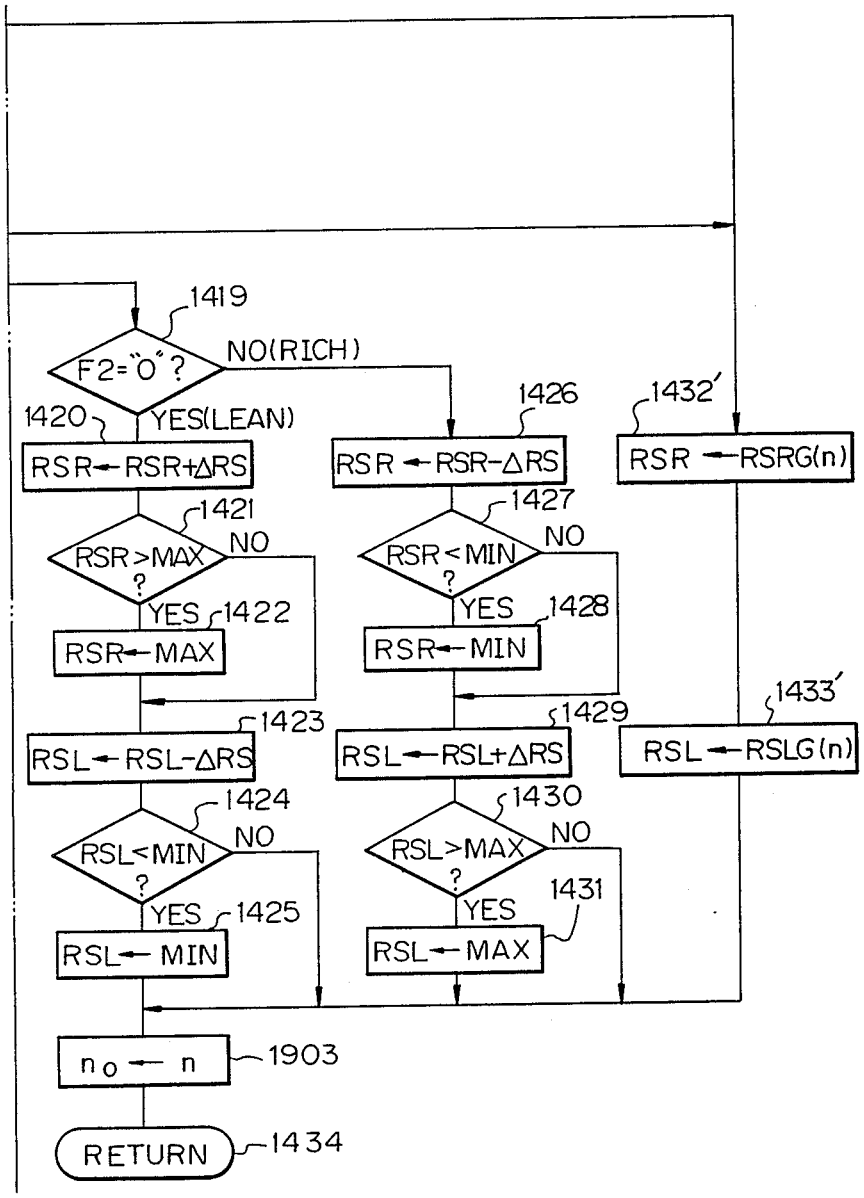
Figure 19C:
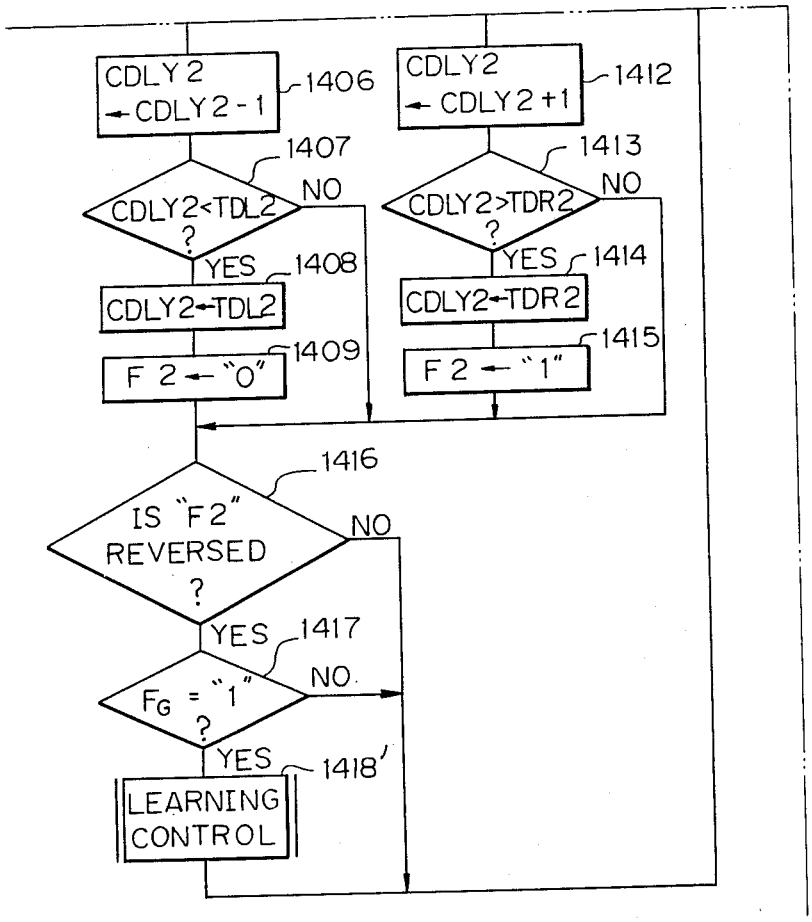

In FIG. 19, which is a modification of FIG. 14, steps 1401, 1402, and 1403 are added to FIG. 14 and steps 1418, 1432 and 1433 are modified to steps 1418', 1432', 1433', respectively. That is, at step 1401, if the air-fuel ratio feedback control conditions by the downstream-side $O_2$ sensor 15 are satisfied, the control proceeds to step 1901, which reads the intake air amount data Q and calculates $$n \leftarrow Q/\Delta Q$$

Where $\Delta Q$ is a constant. Note that n is an integer, and accordingly, fractions of $Q/\Delta Q$ are omitted. Thus, the engine state is divided into a plurality of driving regions n:

| | |
|---|---|
| region 0: | $0 < Q < \Delta Q$ |
| region 1: | $\Delta Q \leqq Q < 2\Delta Q$ |
| ⋮ | ⋮ |
| region k: | $k\Delta Q \leqq Q < (k+1)\Delta Q$ |

-continued

At step 1902, it is determined whether or not the current driving region n is the same as the previous driving region $n_0$. As a result, if $n=n_0$, the control proceeds to step 1902. Otherwise, the control proceeds to steps 1432' and 1433'.

Therefore, when the air-fuel ratio feedback control conditions by the downstream-side $O_2$ sensor 15 is not satisfied, or when the driving region n is changed, at steps 1432' and 1433', the skip amounts RSR and RSL are made the learning values RSRG(n) and RSLG(n) for the corresponding driving region n. Note that the learning values RSRG(n) and RSLG(n) are stored in the backup RAM 106 as follows:

| n | RSRG(n) | RSLG(n) |
|---|---|---|
| 0 | RSRG(0) | RSLG(0) |
| 1 | RSRG(1) | RSLG(1) |
| . | . | . |
| . | . | . |
| k | RSRG(k) | RSLG(k) |
| . | . | . |
| . | . | . |

Note that step 1903 stores the driving region n as the previous driving region $N_0$ in the RAM105 in order to execute the next operation.

Figure 20:
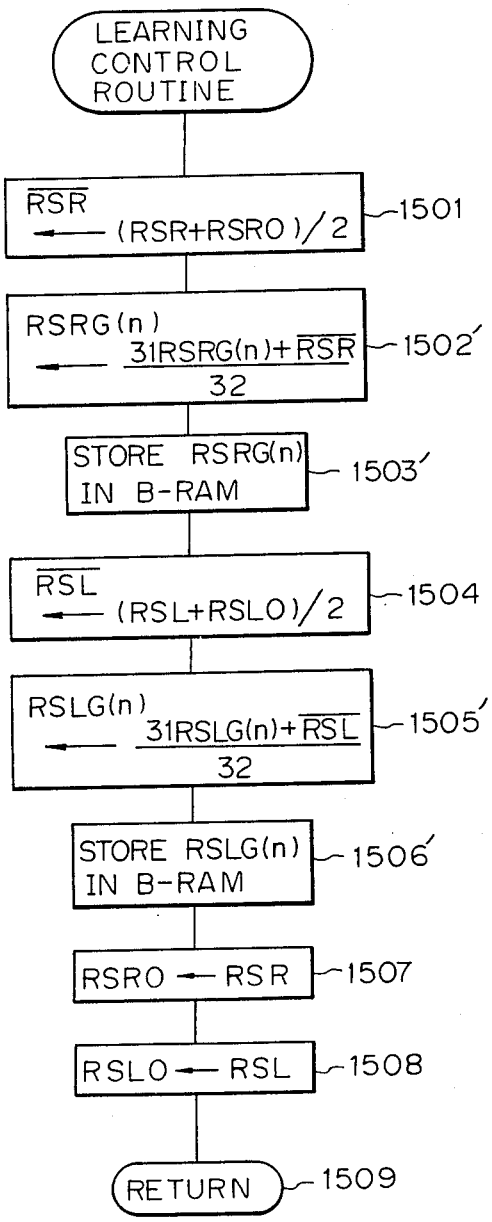

The learning control step 1418' will be explained with reference to FIG. 20. As explained above, this routine is carried out when the driving region n is unchanged and the delayed output of the downstream-side $O_2$ sensor 15 is reversed under the condition that all of the learning conditions are satisfied. In FIG. 20, steps 1502, 1503, 1505, and 1506 of FIG. 15 are modified to steps 1502', 1503', 1505' and 1506', respectively. That is, at step 1502', the learning value RSRG(n) for the current driving region n is renewed by $$RSRG(n) \leftarrow \frac{31\ RSRG(n) + \overline{RSR}}{32}$$

where $\overline{RSR}$ is a mean value of the rich skip amount RSR calculated at step 1501. Then, at step 1503', the learning value RSRG(n) is stored in the corresponding area of the backup RAM 106. Similarly, at step 1505', the learning value RSLG(n) for the current driving region n is renewed by $$RSLG(n) \leftarrow \frac{31 RSLG(n) + \overline{RSL}}{32}$$

where RSL is a mean value of the skip amount RSL calculated at step 1504. Then, at step 1505', the learning value RSLG(n) is stored in the corresponding area of the backup RAM 106.

Figures 21A, 21B:
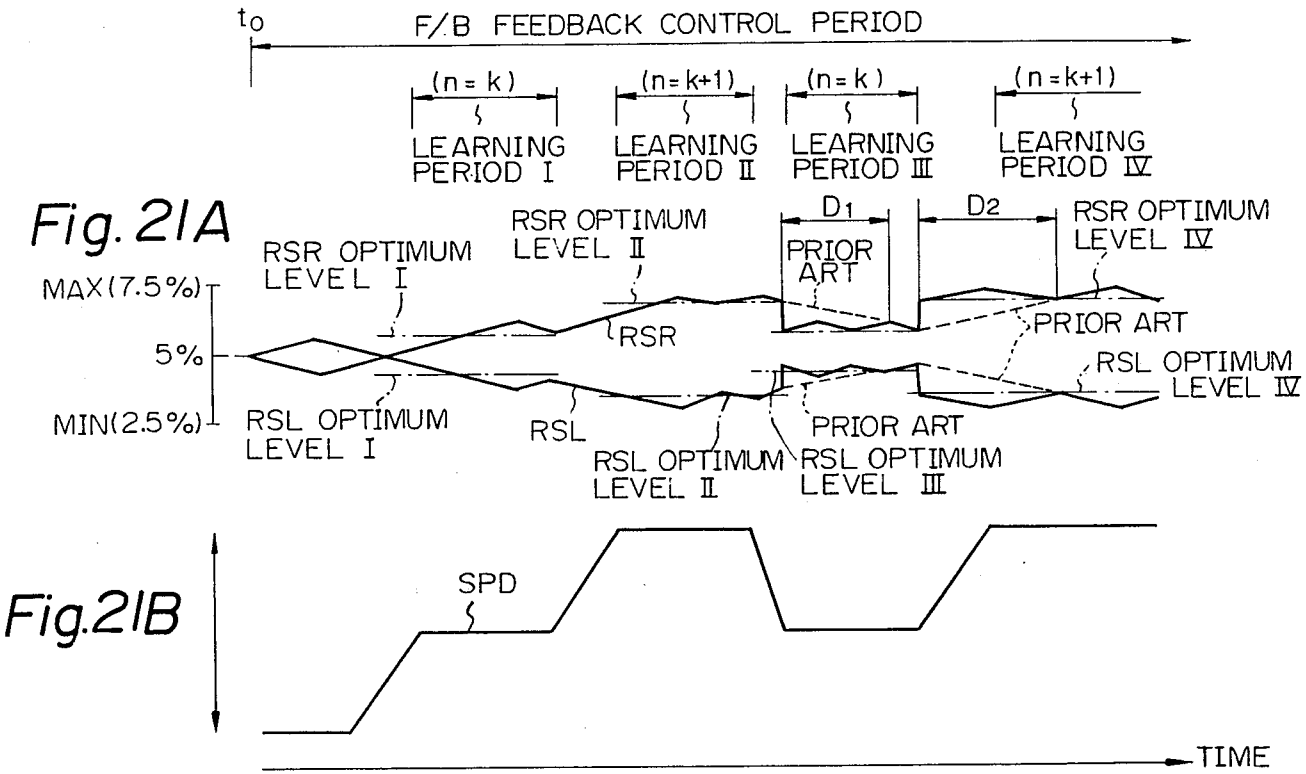
FIGS. 21A and 21B are timing diagrams explaining the routines of FIGS. 3, 3A–3C, 6, 16, 19, 19A–19C and 20.

FIGS. 21A and 21B are timing diagrams for explaining the skip amounts RSR and RSL obtained by the flow charts of FIGS. 3, 6, 16, 19, and 20. That is, the routines of FIGS. 19 and 20 are used instead of those of FIGS. 14 and 15. In FIGS. 21A and 21B, the air-fuel ratio feedback control by the downstream-side $O_2$ sensor 15 is carried out after time $t_0$. When the vehicle speed SPD is changed as shown in FIG. 21B, the driving region n is changed, and accordingly, the optimum levels of the skip amounts RSR and RSL are also changed (see I→II→III→IV). As a result, as shown in FIG. 21A, the skip amounts RSR and RSL are brought close to their corresponding optimum levels by the air-fuel ratio feedback control by the downstream side $O_2$ sensor 15. Further, during each learning time period I, II, III, or IV, a learning control operation is carried out, thereby renewing the learning values RSRG(n) and RSLG(n). Here, if the optimum levels I and III belong to the same driving region n (=k), and the optimum levels II and IV belong to the same driving region n (=k+1), the learning values RSRG(k) and RSLG(k) are used for the skip amounts RSR and RSL, respectively, at the transition from the learning time period II to the learning time period III, and the learning values RSRG(n) and RSLG(n) are used for the skip amounts RSR and RSL, respectively, at the transition from the learning time period III to the learning time period IV. Therefore, in an air-fuel ratio feedback control state by the downstream-side $O_2$ sensor 15, even when the driving region n is changed, the skip amounts RSR and RSL promptly reach their corresponding optimum levels. Of course, even when the engine goes from an open control to an air-fuel ratio feedback control by the downstream-side $O_2$ sensor 15, the skip amounts RSR and RSL promptly reach their corresponding optimum levels, since the skip amounts RSR and RSL also start from their corresponding learning values RSRG(n) and RSLG(n).

Note that, as indicated by a dotted line in FIG. 21A, when the skip amounts RSR and RSL are changed only by the air-fuel ratio feedback control of the downstream-side $O_2$ sensor 15, and the driving region n is changed, it takes a long time $D_1$ or $D_2$ for the skip amounts RSR and RSL to reach their corresponding optimum levels. This delay time $D_1$ or $D_2$ causes a deterioration of the fuel consumption, the drivability, and the conditions of the exhaust emissions.

The reason of provision of a plurality of driving regions n for the intake air amount Q at steps 1101 and 1901 of FIGS. 11 and 19 is as follows. As explained above, the upstream-side $O_2$ sensor 13 is provided on the concentration portion of the exhaust manifold 11, so that the upstream-side $O_2$ sensor 13 can respond to the homogeneously mixed exhaust gas from the cylinders. That is, when the intake air amount Q is large, the exhaust gas from each cylinder is sufficiently mixed at the concentration portion of the exhaust manifold 11. When the intake air amount Q is small, however, the exhaust gas from each cylinder is insufficiently mixed, so that the upstream-side $O_2$ sensor 13 is strongly affected by a specific cylinder. On the other hand, since the downstream-side $O_2$ sensor 15 is provided on the downstream-side of the catalyst converter 12, the downstream-side $O_2$ sensor 15 can respond to the sufficiently homogeneous exhaust gas regardless of the intake air amount Q. Therefore, when the intake air amount Q is large, a high accuracy of the air-fuel ratio feedback control by the downstream-side $O_2$ sensor 15 is unnecessary since the accuracy of the air-fuel ratio feedback control by the upstream-side $O_2$ sensor 13 is high. Contrary to this, when the intake air amount Q is small, a high accuracy of the air-fuel ratio feedback control by the downstream-side $O_2$ sensor 15 is necessary, since the accuracy of the air-fuel ratio feedback control by the upstream-side $O_2$ sensor 13 is low. Such a difference in accuracy of the air-fuel ratio feedback control by the downstream-side $O_2$ sensor 15 leads to a difference of required control amounts such as the second air-fuel ratio correction coefficient FAF2 or the skip amounts RSR and RSL. Therefore, a double $O_2$ sensor system can exhibit sufficient ability by carrying out a learning control operation for a plurality of driving regions determined by the intake air amount Q. Note that the value ΔQ at steps 1101 and 1901 can be variable. In this case, the magnitude of the above-mentioned driving regions is not the same. Further, the driving regions can be determined by using other equivalent parameters, such as the intake air amount per one revolution, the intake air pressure, the throttle opening, and the engine speed, individually or in combination.

Also, in the above-mentioned embodiments, although a mean value $\overline{FAF2}$ (or $\overline{RSR}$, $\overline{RSL}$) is obtained by two successive values immediately before skip operations, such a mean value can be obtained by integrating the corresponding value.

Figure 22:
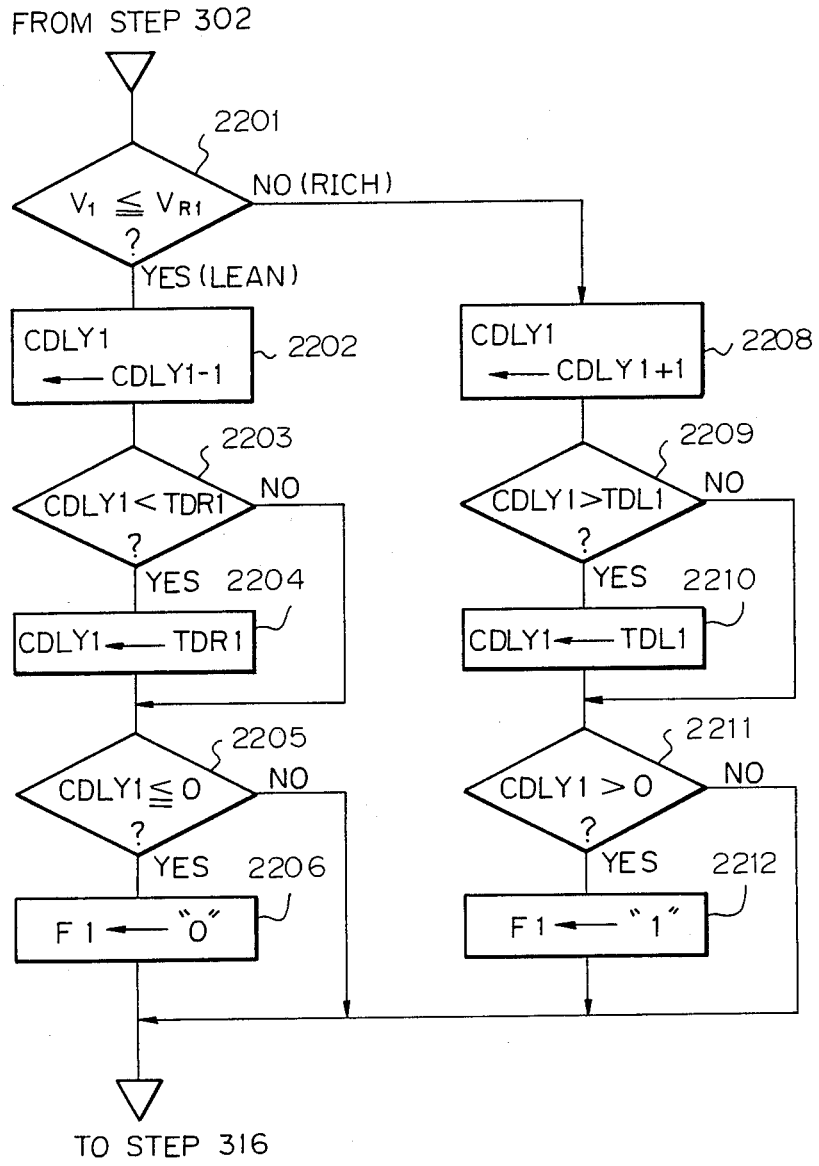
FIG. 22 is a modification of FIGS. 3, 3A–3C.

In FIG. 22, which is a modification of FIG. 3, a delay operation different from the of FIG. 3 is carried out. That is, at step 2201, if $V_1 \leqq V_{R1}$, which means that the current air-fuel ratio is lean, the control proceeds to steps 2202 which decreases a first delay counter CDLY1 by 1. Then, at steps 2203, and 2204, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, then the delayed air-fuel ratio is rich, and if CDLY≦0, then the delayed air-fuel ratio is lean.

Therefore, at step 2205, it is determined whether or not CDLY≦0 is satisfied. As a result, if CDLY1≦0, at step 2206, the first air-fuel ratio flag F1 is made "0" (lean). Otherwise, the first air-fuel ratio flag F1 is unchanged, that is, the flag F1 remains at "1".

On the other hand, if $V_1 > V_{R1}$, which means that the current air-fuel ratio is rich, the control proceeds to step 2208 which increases the first delay counter CDLY1 by 1. Then, at steps 2209 and 2210, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 2211, it is determined whether or not CDLY>0 is satisfied. As a result, if CDLY≦0, at step 2212, the first air-fuel ratio flag F1 is made "1" (rich). Otherwise, the first air-fuel ratio flag F1 is unchanged, that is, the flag F1 remains at "0".

Figures 23A, 23B, 23C, 23D:
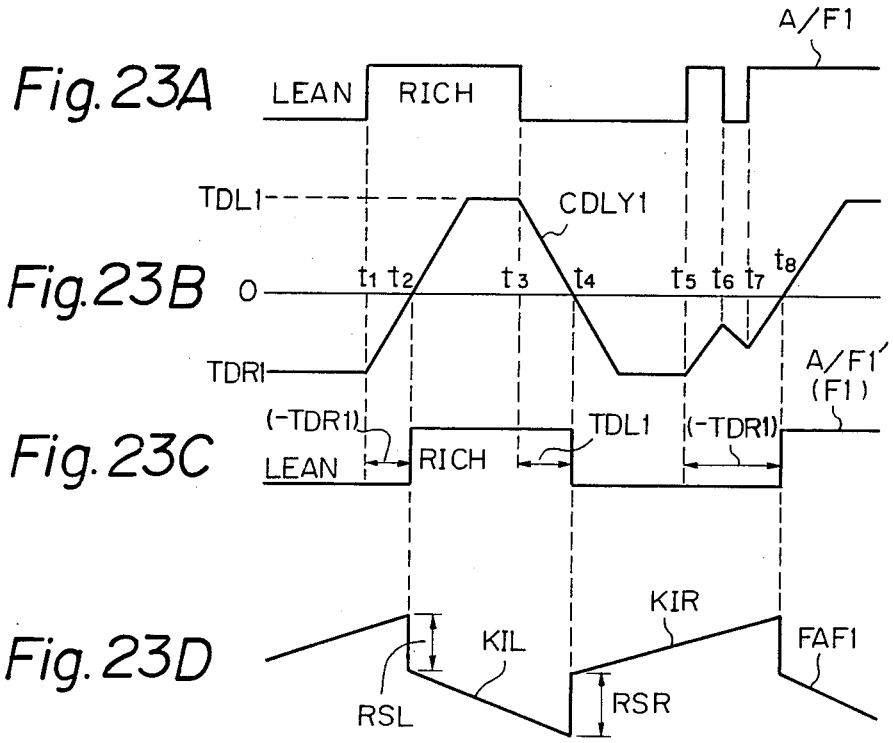
FIGS. 23A through 23D are timing diagrams explaining the flow chart of FIG. 22.

The operation by the flow chart of FIG. 22 will be further explained with reference to FIGS. 23A through 23D. As illustrated in FIG. 23A, when the air-fuel ratio A/F1 is obtained by the output of the upstream-side $O_2$ sensor 13, the first delay counter CDLY1 is counted up during a rich state, and is counted down during a lean state, as illustrated in FIG. 23B. As a result, the delayed air-fuel ratio A/F1′ is obtained as illustrated in FIG. 23C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1′ is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1′ is reversed at time $t_8$. That is, the delayed air-fuel ratio A/F1′ is stable when compared with the air-fuel ratio A/F1. Further, as illustrated in FIG. 23D, at every change of the delayed air-fuel ratio A/F1′ from the rich side to the lean side, or vice versa, the correction amount FAF1 is skipped by the skip amount RSR or RSL, and also, the correction amount FAF1 is gradually increased or decreased in accordance with the delayed air-fuel ratio A/F1′.

Note that, in this case, during an open-control mode, the rich delay time period TDR1 is, for example, −12 (48 ms), and the lean delay time period TDL1 is, for example, 6 (24 ms).

Figure 24:
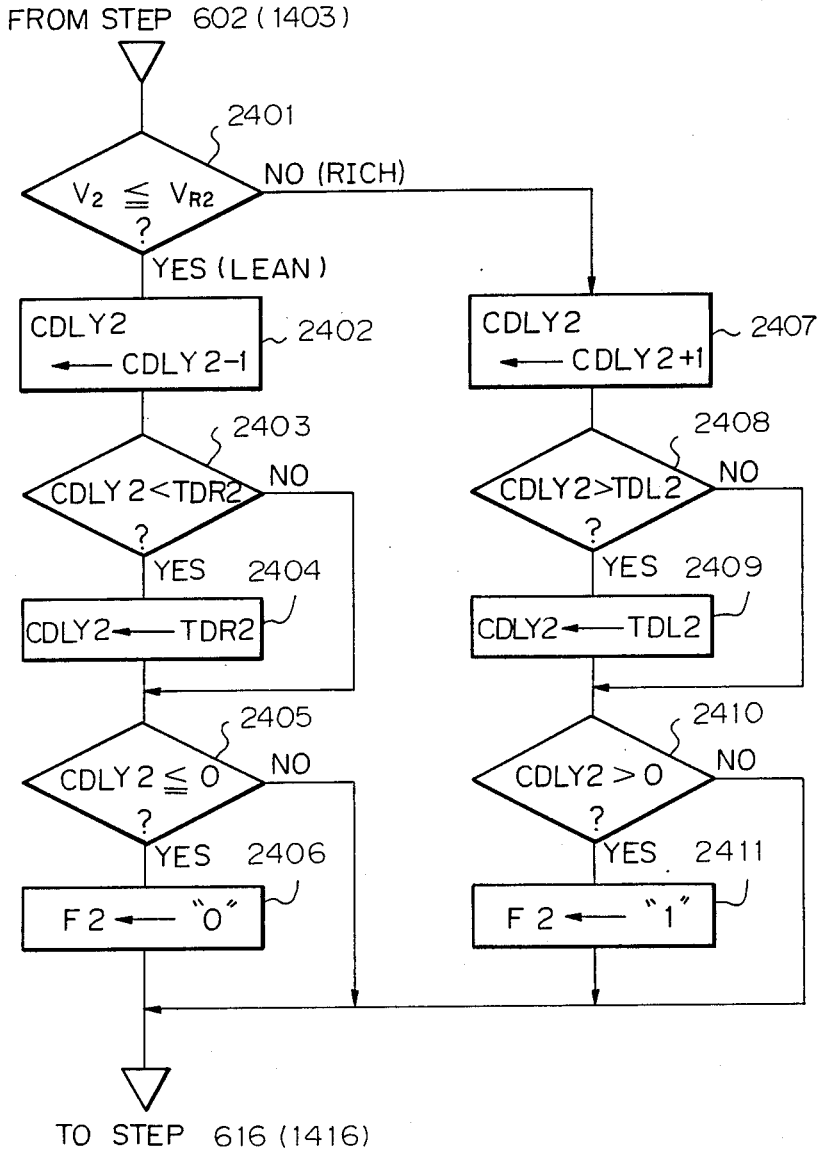
FIG. 24 is a modification of FIGS. 5, 5A–5C, 11, 14, or 19.

In FIG. 24, which is a modification of FIGS. 5, 11, 14, or 19, the same delay operation as in FIG. 22 is carried out, and therefore, a detailed explanation thereof is omitted.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although, in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 801 of FIG. 8 or at step 1601 of FIG. 16 is determined by the carburetor itself, i.e., the intake air negative pressure and the engine speed, and the air amount corresponding to TAU at step 803 of FIG. 8 or at step 1603 of FIG. 16.

Further, a CO sensor, a lean-mixture sensor or the like can be also used instead of the $O_2$ sensor.

We claim:

1. A method for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising the steps of:

calculating a first air-fuel ratio correction amount in accordance with the output of said upstream-side air-fuel ratio sensor;

determining whether said engine is in an air-fuel ratio feedback control state or in an open control state for said downstrema-side air-fuel ratio sensor;

calculating a second air-fuel ratio correction amount in accordance with the output of said downstream-side air-fuel ratio sensor when said engine is in said air-fuel ratio feedback control state;

determining whether or not said engine is in a learning control state;

calculating a center value of said second air-fuel ratio correction amount when said engine is in said learning control state;

storing said center value of said second air-fuel ratio correction amount;

setting said stored center value of said second air-fuel ratio correction amount in said second air-fuel ratio correction amount when said engine is transferred from said open control state to said air-fuel ratio feedback control state;

adjusting an actual air-fuel ratio in accordance with said first and second air-fuel ratio correction amounts;

wherein said learning control state determining step comprises the steps of:

determining whether or not said engine is in an air-fuel ratio feedback control state by both of said first and second air-fuel ratio sensors;

determining whether or not a coolant temperature of said engine is within a predetermined range;

determining whether or not a duration, during which a change of an engine load parameter is smaller than a predetermined value, exceeds a predetermined duration; and setting said learning control state only when all of the above-mentioned determinations are affirmative.

2. A method for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising the steps of:

calculating a first air-fuel ratio correction amount in accordance with the output of said upstream-side air-fuel ratio sensor;

determining whether said engine is in an air-fuel ratio feedback control state, or in an open control state for said downstream-side air-fuel ratio sensor;

calculating a second air-fuel ratio correction amount in accordnace with the output of said downstream-side air-fuel ratio sensor when said engine is in said air-fuel ratio feedback control state;

determining whether or not said engine is in a learning control state;

calculating a center value of said second air-fuel ratio correction amount when said engine is in said learning control state;

storing said center value of said second air-fuel ratio correction amount;

setting said stored center value of said second air-fuel ratio correction amount in said second air-fuel ratio correction amount when said engine is transferred from said open control state to said air-fuel ratio feedback control state;

adjusting an actual air-fuel ratio in accordance with said first and second air-fuel ratio correction amounts; and further comprising a step of determining what engine load regions said engine belongs to, said center value calculating step calculating a center value of said second air-fuel ratio correction amount when said engine is in said learning control state and remains in the same engine load region, said center value storing step storing said center value of said second air-fuel ratio correction amount for the same engine load region, said center value setting step setting said center value of said second air-fuel ratio correction amount stored for the current engine region in said second air-fuel ratio correction amount when said engine is transferred from said open control state to said air-fuel ratio feedback control state or when said engine is transferred to a different engine load region in said air-fuel ratio feedback control state.

3. A method as set forth in claim 2, wherein said engine load regions are determined in accordance with one or more driving parameters such as intake air amount, intake air amount per one revolution, intake air pressure, a throttle opening angle, and an engine speed.

4. A method as set forth in claim 2, wherein said engine load regions are determined by equalization thereof.

5. A method as set forth in claim 2, wherein said engine load regions are determined by nonequalization thereof.

6. A method as set forth in claim 2, wherein said center value setting step sets said center value of said second air-fuel correction amount stored for the current engine load region in said second air-fuel correction amount, when said engine is in said open control state.

7. A method for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a conventration of a specific component in the exhaust gas, comprising the steps of:

determining whether said engine is in an air-fuel ratio feedback control state or in an open control state for said second downstream air-fuel ratio sensor;

calculating an air-fuel ratio feedback control parameter in accordance with the output of said downstream-side air-fuel ratio sensor when said engine is in said air-fuel ratio feedback control state;

determining whether or not said engine is in a learning control state;

calculating a center value of said air-fuel ratio feedback control parameter when said engine is in said learning control state;

storing said center value of said air-fuel ratio feedback control parameter;

setting said stored center value of said air-fuel ratio feedback control parameter in said air-fuel ratio feedback control parameter when said engine is transferred from said open control state to said air-fuel ratio feedback control state;

calculating an air-fuel ratio correction amount in accordance with the output of said upstream-side air-fuel ratio sensor and said air-fuel ratio feedback control parameter; and adjusting an actual air-fuel ratio in accordance with said air-fuel ratio correction amount;

wherein said learning control state determining step comprises the steps of:

determining whether or not said engine is in an air-fuel ratio feedback control state by both of said first and second air-fuel ratio sensors;

determining whether or not a coolant temperature of said engine is within a predetermined range;

determining whether or not a duration, during which a change of an engine load parameter is smaller than a predetermined value, exceeds a predetermined duration; and setting said learning control state only when all of the above-mentioned determinations are affirmative.

8. A method for controlling an air-fuel ratio in an internal combustion engine having a catalyst converter for removing pollutants in the exhaust gas thereof, and first up stream-side and second downstream-side air-fuel ratio sensors disposed upstream and downstream, respectively, of said catalyst converter, for detecting a concentration of a specific component in the exhaust gas, comprising the steps of:

determining whether said engine is in an air-fuel ratio feedback control state or in an open control state for said second downstream air-fuel ratio sensor;

calculating an air-fuel ratio feedback control parameter in accordance with the output of said downstream-side air-fuel ratio sensor when said engine is in said air-fuel ratio feedback control state;

determining whether or not said engine is in a learning control state;

calculating a center value of said air-fuel ratio feedback control parameter when said engine is in said learning control state;

storing said center value of said air-fuel ratio feedback control parameter;

setting said stored center value of said air-fuel ratio feedback control parameter in said air-fuel ratio feedback control parameter when said engine is transferred from said open control state to said air-fuel ratio feedback control state;

calculating an air-fuel ratio correction amount in accordance with the output of said upstream-side air-fuel ratio sensor and said air-fuel ratio feedback control parameter; and adjusting an actual air-fuel ratio in accordance with said air-fuel ratio correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich said to the lean side.

9. A method for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising the steps of:

determining whether said engine is in an air-fuel ratio feedback control state or in an open control state for said second downstream air-fuel ratio sensor;

calculating an air-fuel ratio feedback control parameter in accordance with the output of said downstream-side air-fuel ratio sensor when said engine is in said air-fuel ratio feedback control state;

determining whether or not said engine is in a learning control state;

calculating a center value of said air-fuel ratio feedback control parameter when said engine is in said learning control state;

storing said center value of said air-fuel ratio feedback control parameter;

setting said stored center value of said air-fuel ratio feedback control parameter in said air-fuel ratio feedback control parameter when said engine is transferred from said open control state to said air-fuel ratio feedback control state;

calculating an air-fuel ratio correction amount in accordance with the output of said upstream-side air-fuel ratio sensor and said air-fuel ratio feedback control parameter; and adjusting an actual air-fuel ratio in accordance with said air-fuel ratio correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

10. A method for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising the steps of:

determining wheter said engine is in an air-fuel ratio feedback control state or in an open control state for said second downstream air-fuel ratio sensor;

calculating an air-fuel ratio feedback control parameter in accordance with the output of said downstream-side air-fuel ratio sensor when said engine is in said air-fuel ratio feedback control state;

determining whether or not said engine is in a learning control state;

calculating a center value of said air-fuel ratio feedback control parameter when said engine is in said learning control state;

storing said center value of said air-fuel ratio feedback control parameter;

setting said stored center value of said air-fuel ratio feedback control parameter in said air-fuel ratio feedback control parameter when said engine is transferred from said open control state to said air-fuel ratio feedback control state;

calculating an air-fuel ratio correction amount in accordance with the output of said upstream-side air-fuel ratio sensor and said air-fuel ratio feedback control parameter; and adjusting an actual air-fuel ratio in accordance with said air-fuel ratio correction amount;

further comprising a step of determining what engine load regions said engine belongs to, said center value calculating step calculating a center value of said air-fuel ratio feedback control parameter when said engine is in said learning control state and remains in the same engine load region, said center value storing step storing said center value of said air-fuel ratio feedback control parameter for the same engine load region, said center value setting step setting said center value of said air-fuel ratio feedback control parameter stored for the current engine region in said air-fuel ratio feedback control parameter when said engine is transferred from said open control state to said air-fuel ratio feedback control state or when said engine is transferred to a different engine load region in said air-fuel ratio feedback control state.

11. A method as set forth in claim 10 wherein said engine load regions are determined in accordance with one or more driving parameters such as an intake air amount, an intake air amount per one revolution, intake air pressure, a throttle opening angle, and an engine speed.

12. A method as set forth in claim 10, wherein said engine load regions are determined by equaliation thereof.

13. A method as set forth in claim 10, wherein said engine load regions are determined by nonequalization thereof.

14. A method as set forth in claim 10, wherein said center value setting step sets said stored center value of said air-fuel feedback control parameter stored for the current engine load region in said air-fuel feedback control parameter, when said engine is in said open control state.

15. An apparatus for controlling an air-fuel ratio in a internal combustion engine having a catalyst converter for removing pollants in the exhaust gas thereof, and first upstream-side and second downstream-side air-fuel ratio sensors disposed upstream and downstream, respectively, of said catalyst converter, for detecting a concentration of a specific component in the exhaust gas, comprising:

means for calculating a first air-fuel ratio correction amount in accordance with the output of said upstream-side air-fuel ratio sensor;

means for determining whether said engine is in an air-fuel ratio feedback control state or in an open control state for said downstream-side air-fuel ratio sensor;

means for calculating a second air-fuel ratio correction amount in accordance with the output of said downstream-side air-fuel ratio sensor when said engine is in said air-fuel ratio feedback control state;

means for determining whether or not said engine is in a learning control state;

means for calculating a center value of said second air-fuel ratio correction amount when said engine is in said learning control state;

means for storing said center value of said second air-fuel ratio correction amount;

means for setting said stored center value of said second air-fuel ratio correction amount in said second air-fuel ratio correction amount when said engine is transferred from said open control state to said air-fuel ratio feedback control state;

means for adjusting an actual air-fuel ratio in accordance with said first and second air-fuel ratio correction amounts;

wherein said learning control state determining means comprises:

means for determining whether or not said engine is in an air-fuel ratio feedback control state by both of said first and second air-fuel ratio sensors;

means for determining whether or not a coolant temperature of said engine is within a predetermined range;

means for determining whether or not a duration, during which a change of an engine load parameter is smaller than a predetermined value, exceeds a predetermined duration; and means for setting said learning control state only when all of the above-mentioned determinations are affirmative.

16. An apparatus for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising:

means for calculating a first air-fuel ratio correction amount in accordance with the output of said upstream-side air-fuel ratio sensor;

means for determining whether said engine is in an air-fuel ratio feedback control state or in an open control state for said downstream-side air-fuel ratio sensor;

means for calculating a second air-fuel ratio correction amount in accordance with the output of said downstream-side air-fuel ratio sensor when said engine is in said air-fuel ratio feedback control state;

means for determining whether or not said engine is in a learning control state;

means for calculating a center value of said second air-fuel ratio correction amount when said engine is in said learning control state;

means for storing said center value of said second air-fuel ratio correction amount;

means for setting said stored center value of said second air-fuel ratio correction amount in said second air-fuel ratio correction amount when said engine is transferred from said open control state to said air-fuel ratio feedback control state;

means for adjusting an actual air-fuel ratio in accordance with said first and second air-fuel ratio correction amounts;

further comprising means for determining what engine load regions said engine belongs to, said center value calculating means calculating a center value of said second air-fuel ratio correction amount when said engine is in said learning control state and remains in the same engine load region, said center value storing means storing said center value of said second air-fuel ratio correction amount for the same engine load region, said center value setting means setting said center value of said second air-fuel ratio correction amount stored for the current engine region in said second air-fuel ratio correction amount when said engine is transferred from said open control state to said air-fuel ratio feedback control state or when said engine is transferred to a different engine load region in said air-fuel ratio feedback control state.

17. An apparatus as set forth in claim 16, wherein said engine load regions are determined in accordance with one or more driving parameter such as intake air amount, intake air amount per one revolution, intake air pressure, a throttle opening angle, and an engine speed.

18. An apparatus as set forth in claim 16, wherein said engine load regions are determined by equalization thereof.

19. An apparatus as set forth in claim 16, wherein said engine load regions are determined by nonequalizing thereof.

20. An apparatus as set forth in claim 16, wherein said center value setting means sets said center value of said second air-fuel correction amount stored for the current engine load region in said second air-fuel correction amount, when said engine is in said open control state.

21. An apparatus for controlling an air-fuel ratio in an internal combustion engine having a catlayst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising:

means for determining whether said engine is in an air-fuel ratio feedback control state or in an open control state for said second air-fuel ratio sensor;

means for calculating an air-fuel ratio feedback control parameter in accordance with the output of said downstream-side air-fuel ratio sensor when said engine is in said air-fuel ratio feedback control state;

means for determining whether or not said engine is in a learning control state;

means for calculating a center value of said air-fuel ratio feedback control parameters when said engine is in said learning control state;

means for storing said center value of said air-fuel ratio feedback control parameter;

means for setting said stored center value of said air-fuel ratio feedback control parameter in said air-fuel ratio feedback control parameter when said engine is transferred from said open control state to said air-fuel ratio feedback control state;

means for calculating an air-fuel ratio correction amount in accordance with the output of said upstream-side air-fuel ratio sensor and said air-fuel ratio feedback control parameter; and means for adjusting an actual air-fuel ratio in accordance with said air-fuel ratio correction amount;

wherein said learning control state determining means comprises:

means for determining whether or not said engine is in an air-fuel ratio feedback control state by both of said first and second air-fuel ratio sensors;

means for determining whether or not a coolant temperature of said engine is within a predetermined range;

means for determining whether or not a duration, during which a change of an engine load parameter is smaller than a predetermined value, exceeds a predetermined duration; and means for setting said learning control state only when all of the above-mentioned determinations are affirmative.

22. An apparatus for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising:

means for determining whether said engine is in an air-fuel ratio feedback control state or in an open control state for said second air-fuel ratio sensor;

means for calculating an air-fuel ratio feedback control parameter in accordance with the output of said downstream-side air-fuel ratio sensor when said engine is in said air-fuel ratio feedback control state;

means for determining whether or not said engine is in a learning control state;

means for calculating a center value of said air-fuel ratio feedback control parameters when said engine is in said learning control state;

means for storing said center value of said air-fuel ratio feedback control parameter;

means for setting said stored center value of said air-fuel ratio feedback control parameter in said air-fuel ratio feedback control parameter when said engine is transferred from said open control state to said air-fuel ratio feedback control state;

means for calculating an air-fuel ratio correction amount in accordance with the output of said upstream-side air-fuel ratio sensor and said air-fuel ratio feedback control parameter; and means for adjusting an actual air-fuel ratio in accordance with said air-fuel ratio correction amount;

wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

23. An apparatus for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising:

means for determining whether said engine is in an air-fuel ratio feedback control state or in an open control state for said second air-fuel ratio sensor;

means for calculating an air-fuel ratio feedback control parameter in accordance with the output of said downstream-side air-fuel ratio sensor whne said engine is in said air-fuel ratio feedback control state;

means for determining whether or not said engine is in a learning control state;

means for calculating a center value of said air-fuel ratio feedback control parameters when said engine is in said learning control state;

means for storing said center value of said air-fuel ratio feedback control parameter;

means for setting said stored center value of said air-fuel ratio feedback control parameter in said air-fuel ratio feedback control parameter when said engine is transferred from said open control state to said air-fuel ratio feedback control state;

means for calculating an air-fuel ratio correction amount in accordance with the output of said upstream-side air-fuel ratio sensor and said air-fuel ratio feedback control parameter; and means for adjusting an actual air-fuel ratio in accordance with said air-fuel ratio correction amount;

wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel sensor is on the lean side.

24. An apparatus for controlling an air-fuel ratio in an internal combustion engine having a catalyst converter for removing pollutants in the exhaust gas thereof, and first upstream-side and second downstream-side air-fuel ratio sensors disposed upstream and downstream, respectively, of said catalyst converter, for detecting a concentration of a specific component in the exhaust gas, comprising:

means for determining whether said engine is in an air-fuel ratio feedback control state or in an open control state for said second air-fuel ratio sensor;

means for calculating an air-fuel ratio feedback control parameter in accordance with the output of said downstream-side air-fuel ratio sensor when said engine is in said air-fuel ratio feedback control state;

means for determining whether or not said engine is in a learning control state;

means for calculating a center value of said air-fuel ratio feedback control parameters when said engine is in said learning control state;

means for storing said center value of said air-fuel ratio feedback control parameter;

means for setting said stored center value of said air-fuel ratio feedback control parameter in said air-fuel ratio feedback control parameter when said engine is transferred from said open control state to said air-fuel ratio feedback control state;

means for calculating an air-fuel ratio correction amount in accordance with the output of said upstream-side air-fuel ratio sensor and said air-fuel ratio feedback control parameter; and means for adjusting an actual air-fuel ratio in accordance with said air-fuel ratio correction amount;

further comprising means for determining what engine load regions said engine belongs to, said center value calculating means calculating a center value of said air-fuel ratio feedback control parameter when said engine is in said learning control state and remains in the same engine load region;

said center value storing means storing said center value of said air-fuel ratio feedback control parameter for the same engine load region, said center value setting means setting said center value of said air-fuel ratio feedback control parameter stored for the current engine region in said air-fuel ratio feedback control parameter when said engine is transferred from said open control state to said air-fuel ratio feedback control state or when said engine is transferred to a different engine load region in said air-fuel ratio feedback control state.

25. An apparatus as set forth in claim 24, wherein said engine load regions are determined in accordance with one or more driving parameters such as intake air amount, intake air amount per one revolution, intake air pressure, a throttle opening angle, and an engine speed.

26. An apparatus as set forth in claim 24, wherein said engine load regions are determined by equalization thereof.

27. An apparatus as set forth in claim 24, wherein said engine load regions are determined by nonequalization thereof.

28. An apparatus as set forth in claim 24, wherein said center value setting means sets said stored center value of said air-fuel feedback control parameter stored for the current engine load region in said air-fuel feedback control parameter, when said engine is said open control state.

* * * * *